US011867175B2

(12) United States Patent
Kim et al.

(10) Patent No.: US 11,867,175 B2
(45) Date of Patent: Jan. 9, 2024

(54) SCROLL COMPRESSOR

(71) Applicant: LG Electronics Inc., Seoul (KR)

(72) Inventors: Taekyoung Kim, Seoul (KR); Sungyong Ahn, Seoul (KR); Junghoon Park, Seoul (KR); Jaeha Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/993,417

(22) Filed: Nov. 23, 2022

(65) Prior Publication Data

US 2023/0167820 A1 Jun. 1, 2023

(30) Foreign Application Priority Data

Nov. 30, 2021 (KR) ..... 10-2021-0169212

(51) Int. Cl.
*F04C 29/02* (2006.01)
*F04C 18/02* (2006.01)
*F04C 29/12* (2006.01)

(52) U.S. Cl.
CPC ..... *F04C 18/0215* (2013.01); *F04C 18/0261* (2013.01); *F04C 29/12* (2013.01); *F04C 2210/206* (2013.01)

(58) Field of Classification Search
CPC ..... F04C 18/0215; F04C 18/0253; F04C 18/0261; F04C 29/023; F04C 29/026
See application file for complete search history.

(56) References Cited

FOREIGN PATENT DOCUMENTS

| | | | | |
|---|---|---|---|---|
| EP | 3567253 | | 11/2018 | |
| EP | 3553318 | | 10/2019 | |
| EP | 3401543 | | 11/2019 | |
| JP | 57018491 | A * | 1/1982 | ..... F04C 29/026 |
| JP | H07259756 | | 10/1995 | |
| JP | WO2004010001 | A1 * | 11/2005 | ..... F01C 21/10 |
| JP | 2017150349 | | 8/2017 | |
| KR | 20050042223 | | 5/2005 | |
| KR | 102318124 | | 10/2021 | |

OTHER PUBLICATIONS

JP57018491 by PE2E Mar. 8, 2023.*
JP-WO2004010001 by PE2E Mar. 8, 2023.*
Office Action in Korean Appln. No. 10-2021-0169212, dated Nov. 10, 2022, 20 pages (with English translation).
Extended European Search Report in European Appln. No. 22202904.3, dated Apr. 5, 2023, 8 pages.

* cited by examiner

*Primary Examiner* — Deming Wan
(74) *Attorney, Agent, or Firm* — Fish & Richardson P.C.

(57) ABSTRACT

A scroll compressor includes a casing having an oil storage space, a fixed scroll disposed inside the casing, an orbiting scroll disposed on one side of the fixed scroll and performing an orbiting motion relative to the fixed scroll so as to form a compression chamber, a discharge cover coupled to another side opposite to the one side of the fixed scroll and having a cover bottom surface, and an oil feeder coupled to the cover bottom surface to face a direction opposite to the fixed scroll, to communicate with the oil storage space. The cover bottom surface is disposed at an inner side of an inner circumference of the oil feeder and defines a discharge hole to communicate with the inner side of the oil feeder.

20 Claims, 20 Drawing Sheets

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2021-0169212, filed on Nov. 30, 2021, the contents of which are incorporated by reference herein in their entirety.

TECHNICAL FIELD

The present disclosure relates to a scroll compressor that is capable of adjusting oil temperature by transferring heat of refrigerant, which is discharged to a lower side without using a pipe, to a muffler.

BACKGROUND

A scroll compressor is configured such that an orbiting scroll and a non-orbiting scroll are engaged with each other and a pair of compression chambers is formed while the orbiting scroll performs an orbiting motion with respect to the non-orbiting scroll.

The compression chamber includes a suction pressure chamber formed at an outer side, an intermediate pressure chamber continuously formed toward a central portion from the suction pressure chamber while gradually decreasing in volume, and a discharge pressure chamber connected to the center of the intermediate pressure chamber. Typically, the suction pressure chamber is formed through a side surface of the non-orbiting scroll, the intermediate pressure chamber is sealed, and the discharge pressure chamber is formed through an end plate of the non-orbiting scroll.

Scroll compressors may be classified into a low-pressure type and a high-pressure type according to a path through which refrigerant is suctioned. The low-pressure type is configured such that a refrigerant suction pipe is connected to an inner space of a casing to guide suction refrigerant of low temperature to flow into a suction pressure chamber via the inner space of the casing. On the other hand, the high-pressure type is configured such that the refrigerant suction pipe is connected directly to the suction pressure chamber to guide refrigerant to flow directly into the suction pressure chamber without passing through the inner space of the casing.

A bottom-compression type scroll compressor is widely configured as a bottom-compression high-pressure type compressor in which a compression part including a fixed scroll and an orbiting scroll is located below a motor part that transmits power to turn the orbiting scroll, such that refrigerant gas directly supplied into the compression part is compressed and then flows to an upper space within a case.

Meanwhile, Patent Document 1 (KR Publication Patent Application No. 10-2005-0042223) discloses a compressor having an oil temperature adjustment function.

Patent Document 1 discloses a compressor that includes a casing defining an accommodating space therein to store oil, a compression part accommodated in the casing to compress refrigerant, an oil heating unit for heating the oil inside the casing, the oil heating unit provided with a high-temperature refrigerant passage having one side branched from a discharge side of the compression part and another side connected to a downstream side of a condenser via the inside of the casing so as to be in contact with the oil inside the casing, and an oil cooling unit for cooling the oil inside the casing, the oil cooling unit provided with a low-temperature refrigerant passage having one side connected to a downstream side of an expander and another side connected to the casing from the outside of the casing so as to be in contact with the oil inside the casing.

As described above, the compressor of Patent Document 1 has an oil-temperature adjustment function capable of suppressing lubrication failure due to an excessive change in oil temperature.

In particular, a portion of a discharge refrigerant pipe was branched to be disposed in an oil storage space, to heat oil through a valve when necessary. Also, a portion of a suction refrigerant pipe was branched to be disposed in the oil storage space, to cool oil through a valve when necessary. In these two cases, the temperature of the oil was adjusted.

As described above, the compressor of Patent Document 1 discloses a method of cooling or heating oil in an oil storage space by disposing suction and discharge refrigerant pipes in the oil storage space.

However, in the compressor using the method of cooling or heating the oil in the oil storage space by arranging the suction and discharge refrigerant pipes in the oil storage space, as disclosed in Patent Document 1, oil is left in low temperature or oil superheat is not secured at the beginning of operation, which causes the oil to flow in a low-viscosity state. When the oil flows in the low-viscosity state, problems such as damage on bearings inside the compressor and lowering of an oil level are caused.

Therefore, there is a need to develop a scroll compressor that is capable of adjusting temperature of oil without using a pipe.

SUMMARY

The present disclosure has been invented to solve the above problems, and one aspect of the present disclosure is to provide a scroll compressor capable of adjusting temperature of oil without using a pipe.

Another aspect of the present disclosure is to provide a scroll compressor capable of adjusting temperature of oil in an oil storage space by transferring heat through a muffler.

Still another aspect of the present disclosure is to provide a scroll compressor capable of preventing oil from being supplied in a low-viscosity state.

Still another aspect of the present disclosure is to provide a scroll compressor in which oil inside an oil storage space is stirred with being in direct contact with discharge refrigerant.

Still another aspect of the present disclosure is to provide a scroll compressor capable of operating at an oil circulation ratio (OCR) optimized for a preset operation condition.

Still another aspect of the present disclosure is to provide a scroll compressor having a structure for reducing scattering of oil due to injected refrigerant while adjusting temperature of oil in an oil storage space.

Still another aspect of the present disclosure is to provide a scroll compressor capable of improving circulation in a compressor, in particular, circulation of recovered oil in an upper side of the compressor by forming a gas drain hole for resolving differential pressure in a lower side of the compressor near an oil storage space.

In order to solve those aspects according to one implementation, there is provided a scroll compressor that may include a casing having an oil storage space, a fixed scroll disposed inside the casing, an orbiting scroll disposed on one side of the fixed scroll and performing an orbiting motion relative to the fixed scroll so as to form a compression chamber, a discharge cover coupled to another side opposite to the one side of the fixed scroll and having a cover bottom surface, and an oil feeder coupled to the cover bottom surface to face a direction opposite to the fixed scroll, to communicate with the oil storage space. The cover bottom surface disposed at an inner side of an inner circumference of the oil feeder may be provided with a discharge hole formed to communicate with the inner side of the oil feeder.

With the configuration, the scroll compressor of the present disclosure can adjust temperature of oil in the oil storage space without using a pipe.

In addition, as the discharge hole of the discharge cover is formed through the cover bottom surface located at the inner side of the oil feeder, scattering of oil due to injected refrigerant can be reduced while adjusting temperature of oil in the oil storage space.

The discharge cover may further include a cover side portion extending from the cover bottom surface toward the fixed scroll, and a discharge space defined by the cover bottom surface, the cover side portion, and the fixed scroll.

Accordingly, refrigerant collected in the discharge space is moved to the oil storage space through the muffler hole. The oil in the storage space can thus be brought into direct contact with and stirred with a discharged refrigerant.

The cover bottom surface may be provided with a refrigerant guide member disposed on one side thereof, opposite to the fixed scroll, to be adjacent to the discharge hole, and extending to overlap the muffler hole in one direction to collide with refrigerant passing through the discharge hole.

With the configuration, the refrigerant guide member extends in a predetermined direction to guide a flow of refrigerant in the predetermined direction.

The oil feeder may include an oil suction pipe coupled through the discharge cover, and a blocking member accommodating the oil suction pipe to block an introduction of foreign substances.

The scroll compressor may further include a main frame fixedly disposed on an opposite side of the fixed scroll with the orbiting scroll interposed therebetween, and the main frame and the fixed scroll may be provided with a gas drain hole through which gas inside the oil storage space flows out of the casing.

As such, as the gas drain hole is formed in an inner circumference of a balance weight, refrigerant of high pressure in the oil storage space can flow along the inner circumference of the balance weight with relatively low pressure so as to be discharged to outside through the refrigerant discharge pipe disposed inside the casing, thereby relieving differential pressure in a lower portion of the compressor near the oil storage space.

The gas drain hole may include an upper communication portion formed through an upper surface of the main frame, and a lower communication portion communicating with the oil storage space such that refrigerant gas in the oil storage space partially flows to the upper communication portion.

The gas drain hole may further include a middle communication portion formed in an upper surface of the main frame in a direction crossing the upper communication portion such that the upper communication portion and the lower communication portion communicate with each other.

The main frame may include a frame side wall extending in a cylindrical shape from an edge of a lower side surface thereof, and the fixed scroll may include a fixed side wall formed in an annular shape on a side portion thereof and coupled to the frame side wall to face the frame side wall in a vertical direction. The lower communication portion may include a first communication hole formed in the fixed side wall in the vertical direction, and a second communication hole formed in the frame side wall in the vertical direction, and having an upper portion communicating with the middle communication portion and a lower portion communicating with the first communication hole.

The scroll compressor may further include a driving motor to generate rotational force by receiving external power to pivot the orbiting scroll. A balance weight that is disposed between the driving motor and the main frame and extends by a predetermined angle in a circumferential direction may be coupled to the driving motor so as to be rotatable by rotation of the driving motor. The upper communication portion may further be disposed in an inner circumferential space of the balance weight.

The main frame may include a main bearing accommodating portion protruding from an upper surface thereof and having an inner circumference on which a bearing is fitted, and the upper communication portion may further be disposed between an inner circumferential space of the balance weight and an outer circumferential space of the main bearing accommodating portion.

According to another example, the main frame may include a frame end plate defining an upper surface, and a main bearing accommodating portion protruding from the frame end plate and having an inner circumference on which a bearing is fitted, and the upper communication portion may include a main communication hole formed in the frame end plate in the vertical direction, and an upper discharge space communicating with the main communication hole and disposed between an inner circumference of the balance weight and the main bearing accommodating portion.

In order to solve those aspects according to another implementation, there is provided a scroll compressor that may include a casing having an oil storage space, a fixed scroll disposed inside the casing, an orbiting scroll disposed on one side of the fixed scroll and performing an orbiting motion relative to the fixed scroll so as to form a compression chamber, and a main frame fixedly disposed on an opposite side of the fixed scroll with the orbiting scroll interposed therebetween. The main frame and the fixed scroll may be provided with a gas drain hole through which gas inside the oil storage space flows out of the casing.

As such, as the gas drain hole is formed in an inner circumference of a balance weight, refrigerant of high pressure in the oil storage space can flow along the inner circumference of the balance weight with relatively low pressure so as to be discharged to outside through the refrigerant discharge pipe inside the casing, thereby relieving differential pressure in a lower portion of the compressor near the oil storage space.

According one example disclosed herein, the gas drain hole may include an upper communication portion formed through an upper surface of the main frame, and a lower communication portion communicating with the oil storage space such that refrigerant gas in the oil storage space partially flows to the upper communication portion.

The gas drain hole may further include a middle communication portion formed in an upper surface of the main frame in a direction crossing the upper communication portion such that the upper communication portion and the lower communication portion communicate with each other.

According another example disclosed herein, the main frame may include a frame side wall extending in a cylindrical shape from an edge of a lower side surface thereof, and the fixed scroll may include a fixed side wall formed in an annular shape on a side portion thereof and coupled to the frame side wall to face the frame side wall in a vertical direction. The lower communication portion may include a first communication hole formed in the fixed side wall in the vertical direction, and a second communication hole formed in the frame side wall in the vertical direction, and having an upper portion communicating with the middle communication portion and a lower portion communicating with the first communication hole.

The scroll compressor may further include a driving motor to generate rotational force by receiving external power to pivot the orbiting scroll. A balance weight that is disposed between the driving motor and the main frame and extends by a predetermined angle in a circumferential direction may be coupled to the driving motor so as to be rotatable by rotation of the driving motor. The upper communication portion may further be disposed in an inner circumferential space of the balance weight.

The main frame may include a frame end plate defining an upper surface, and a main bearing accommodating portion protruding from the frame end plate and having an inner circumference on which a bearing is fitted, and the upper communication portion may include a main communication hole formed in the frame end plate in the vertical direction, and an upper discharge space communicating with the main communication hole and disposed between an inner circumference of the balance weight and the main bearing accommodating portion.

The scroll compressor may further include a discharge cover coupled to another side opposite to the one side of the fixed scroll and having a cover bottom surface, and the cover bottom surface may include a discharge hole communicating with the discharge space and the oil storage space.

The scroll compressor may further include an oil feeder coupled to the cover bottom surface to face a direction opposite to the fixed scroll, to communicate with the oil storage space, and the discharge hole may be formed in the cover bottom surface disposed at an inner side of an inner circumference of the oil feeder so as to communicate with the inner side of the oil feeder.

With the configuration, the scroll compressor of the present disclosure can adjust temperature of oil in the oil storage space without using a pipe.

In addition, as the discharge hole of the discharge cover is formed through the cover bottom surface located at the inner side of the oil feeder, scattering of oil due to injected refrigerant can be reduced while adjusting temperature of oil in the oil storage space.

The scroll compressor may further include an oil feeder coupled to the cover bottom surface to face a direction opposite to the fixed scroll, to communicate with the oil storage space, and the discharge hole may be formed in the cover bottom surface disposed at an outer side of an outer circumference of the oil feeder so as to communicate with the oil storage space.

DETAILED DESCRIPTION

Hereinafter, a scroll compressor 10 according to the present disclosure will be described in detail with reference to the accompanying drawings. In the following description, a description of some components may be omitted to clarify features of the present disclosure.

In addition, the term "upper side" used in the following description refers to a direction away from a support surface for supporting a scroll compressor 10 according to an implementation of the present disclosure, that is, a direction toward a motor part when viewed based on the motor part and a compression part. The term "lower side" refers to a direction toward the support surface, that is, a direction toward the compression part when viewed based on the motor part and the compression part.

The term "axial direction" used in the following description refers to a lengthwise (longitudinal) direction of a rotating shaft 125. The "axial direction" may be understood as an up and down (or vertical) direction. The term "radial direction" refers to a direction that intersects the rotating shaft 125.

In addition, a description will be given of a bottom-compression type scroll compressor 10 in which a motor part and a compression part are arranged vertically in an axial direction and the compression part is located below the motor part.

In addition, a description will be given of a bottom-compression high-pressure type scroll compressor in which a refrigerant suction pipe defining a suction passage is directly connected to a compression part and a refrigerant discharge pipe 116 communicates with an inner space of a casing 110.

Figure 1:
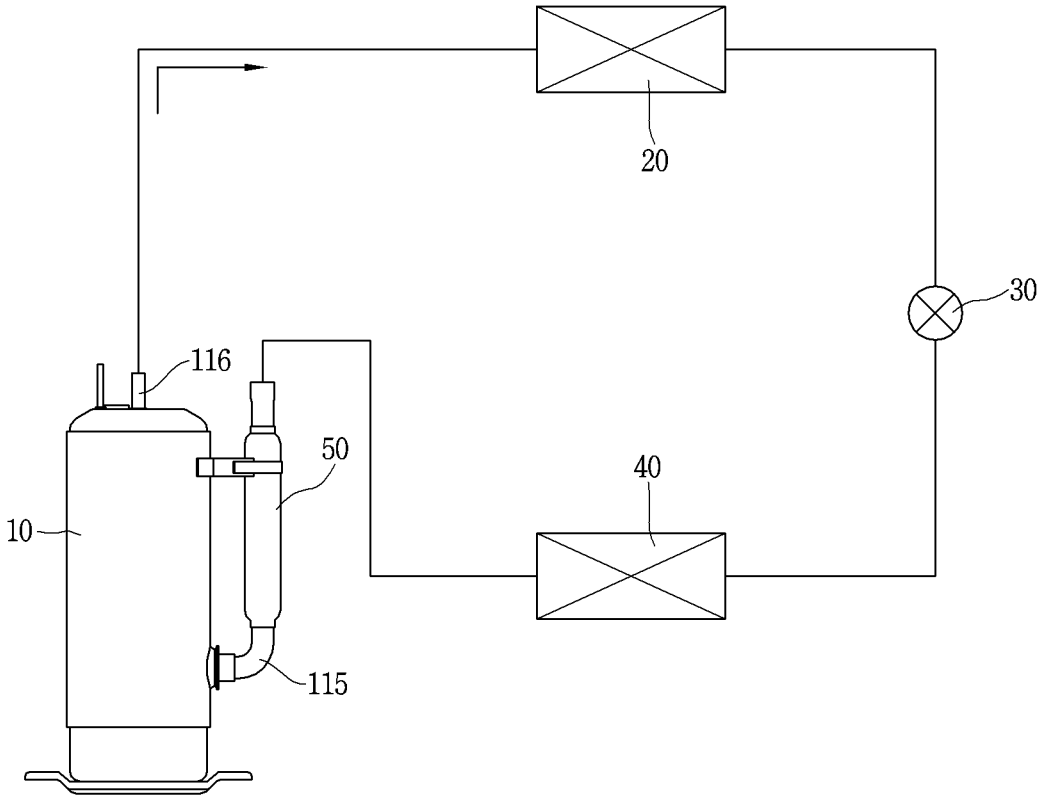
FIG. 1 is a schematic diagram illustrating a refrigeration cycle device including a scroll compressor in accordance with an implementation of the present disclosure.

FIG. 1 is a schematic diagram illustrating a refrigeration cycle device including a scroll compressor 10 in accordance with an implementation of the present disclosure.

Referring to FIG. 1, a refrigeration cycle device including the scroll compressor 10 according to the present disclosure is configured such that the scroll compressor 10, a condenser 20, an expansion apparatus (or expander) 30, and an evaporator 40 form a closed loop.

The condenser 20, the expansion apparatus 30, and the evaporator 40 is sequentially connected to a refrigerant discharge pipe 116 of the scroll compressor 10. Also, a discharge side of the evaporator 40 is connected to a suction side of the scroll compressor 10.

One side of a refrigerant suction pipe 115 is connected to an accumulator 50. In addition, the accumulator 50 is connected to an outlet side of the evaporator 40 through a refrigerant pipe.

Accordingly, while refrigerant flows from the evaporator 40 to the accumulator 50, liquid refrigerant is separated in the accumulator 50, and only gaseous refrigerant is directly introduced into a compression chamber through the refrigerant suction pipe 115.

Accordingly, the refrigerant compressed in the scroll compressor 10 is discharged toward the condenser 20, and then sucked back into the scroll compressor 10 sequentially through the expansion apparatus 30 and the evaporator 40. The series of processes is repeatedly carried out.

Figure 2:
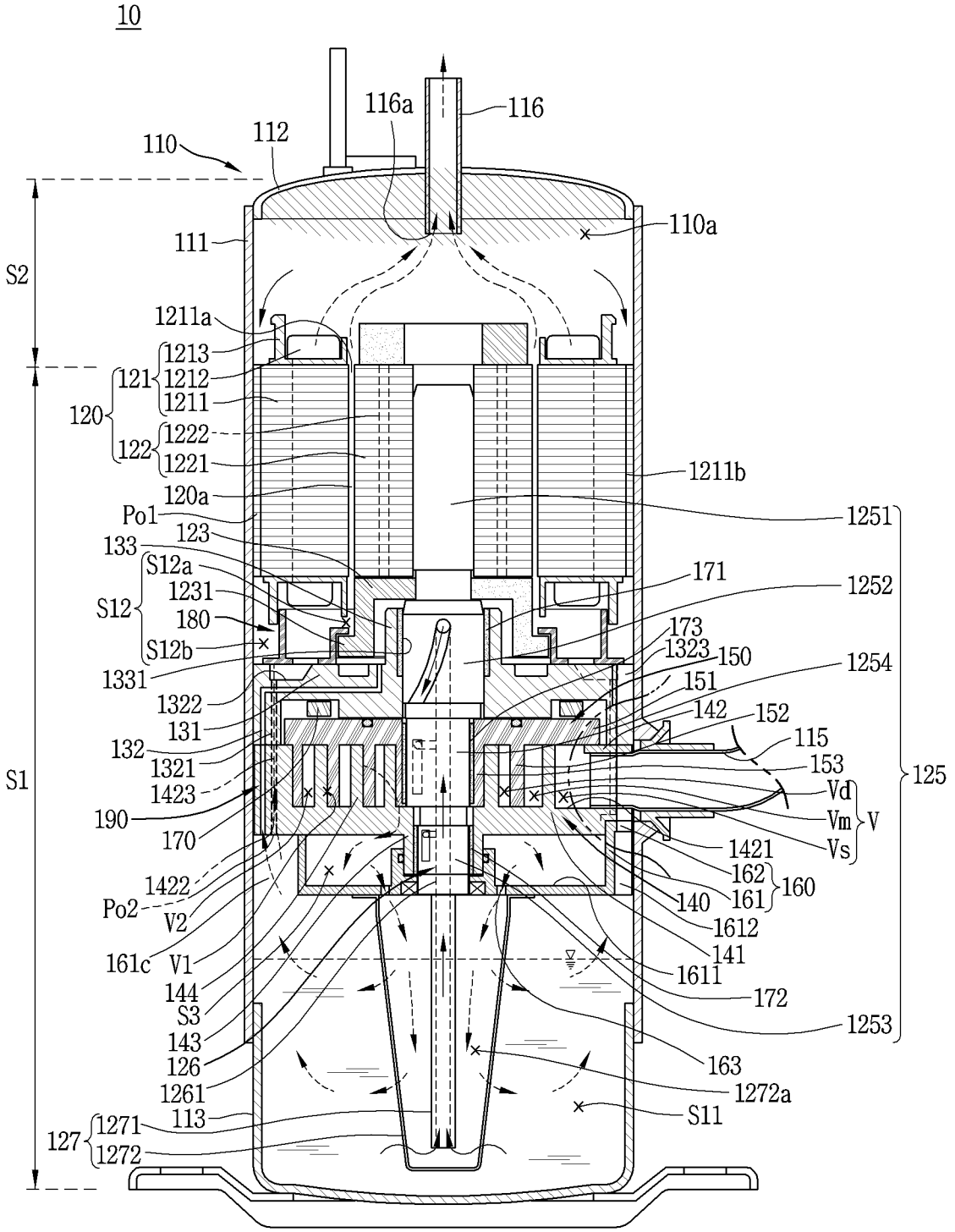
FIG. 2 is a sectional view illustrating the scroll compressor according to the present disclosure.

FIG. 2 is a sectional view illustrating a scroll compressor according to the present disclosure.

Hereinafter, the structure of the scroll compressor 10 will be described with reference to FIG. 2.

The scroll compressor 10 may be an inverter type scroll compressor. The scroll compressor 10 can operate in the range from a low speed to a high speed. The scroll compressor 10 may also be a high-pressure type and a bottom-compression type.

According to an example, the scroll compressor 10 includes a casing 110, a fixed scroll 140, an orbiting scroll 150, a discharge cover 160, and an oil feeder 127.

The casing 110 has an oil storage space S11. As an example, a driving motor 120 may be disposed in an upper portion of the casing 110, and a main frame 130, the orbiting scroll 150, the fixed scroll 140, and the discharge cover 160 may be sequentially disposed below the driving motor 120.

The driving motor 120 may configure the motor part that converts external electrical energy into mechanical energy.

In addition, the main frame 130, the orbiting scroll 150, the fixed scroll 140, and the discharge cover 160 may configure a compression part that compresses refrigerant by receiving the mechanical energy generated in the driving motor 120.

Referring to FIG. 2, an example in which the motor part is coupled to an upper end of a rotating shaft 125 to be explained later, and the compression part is coupled to a lower end of the rotating shaft 125 is illustrated. That is, the scroll compressor 10 may have a lower compression type structure.

In summary, the scroll compressor 10 includes the motor part and the compression part, and the motor part and the compression part are accommodated in an inner space 110*a* of the casing 110.

The casing 110 may include a cylindrical shell 111, an upper shell 112 and a lower shell 113.

The cylindrical shell 111 may be formed in a cylindrical shape with both ends open.

The upper shell 112 may be coupled to an upper end portion of the cylindrical shell 111, and the lower shell 113 may be coupled to a lower end portion of the cylindrical shell 111.

That is, both the upper and lower end portions of the cylindrical shell 111 are coupled to the upper shell 112 and the lower shell 113, respectively, in a covering manner. The cylindrical shell 111, the upper shell 112 and the lower shell 113 that are coupled together define the inner space 110*a* of the casing 110. At this time, the inner space 110*a* is sealed.

The sealed inner space 110*a* of the casing 110 is divided into a lower space S1, an upper space S2, an oil storage space S11, and a discharge space S3.

The lower space S1 and the upper space S2 are defined in an upper side of the main frame 130 and the oil storage space S11 and the discharge space S3 are defined in a lower side of the main frame 130.

The lower space S1 indicates a space defined between the driving motor 120 and the main frame 130, and the upper space S2 indicates a space above the driving motor 120. In addition, the oil storage space S11 indicates a space below the discharge cover 160, and the discharge space S3 indicates a space defined between the discharge cover 160 and the fixed scroll 140.

One end of the refrigerant suction pipe 115 is coupled through a side surface of the cylindrical shell 111. Specifically, the one end of the refrigerant suction pipe 115 is coupled through the cylindrical shell 111 in a radial direction of the cylindrical shell 111.

The refrigerant suction pipe 115 penetrates through the cylindrical shell 111 to be directly coupled to a suction port 1421 (FIG. 6) of the fixed scroll 140. Accordingly, refrigerant can be introduced into a compression chamber V through the refrigerant suction pipe 115.

The accumulator 50 is coupled to another end, different from the one end, of the refrigerant suction pipe 115.

The accumulator 50 is connected to an outlet side of the evaporator 40 through a refrigerant pipe. Accordingly, while refrigerant flows from the evaporator 40 to the accumulator 50, liquid refrigerant is separated in the accumulator 50, and only gaseous refrigerant is directly introduced into a compression chamber through the refrigerant suction pipe 115.

A refrigerant discharge pipe 116 is coupled through an upper portion of the upper shell 112 to communicate with the inner space 110*a* of the casing 110. Accordingly, refrigerant discharged from the compression part into the inner space 110*a* of the casing 110 flows to the condenser 20 through the refrigerant discharge pipe 116.

The configuration of the fixed scroll 140, the orbiting scroll 150, the discharge cover 160, and the oil feeder 127 will be described later.

Figure 3:
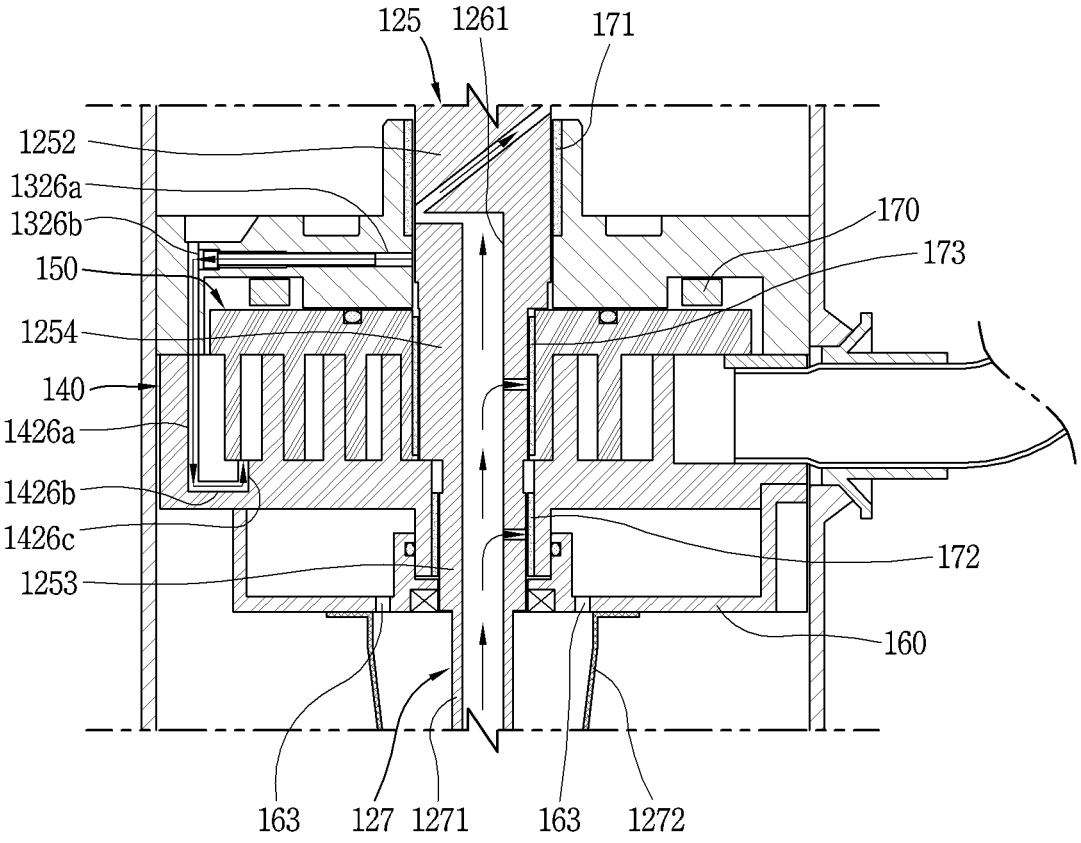
FIG. 3 is a conceptual diagram illustrating a flow of lubricating oil in a rotating shaft and a compression part in the scroll compressor according to the present disclosure.
Figure 4:
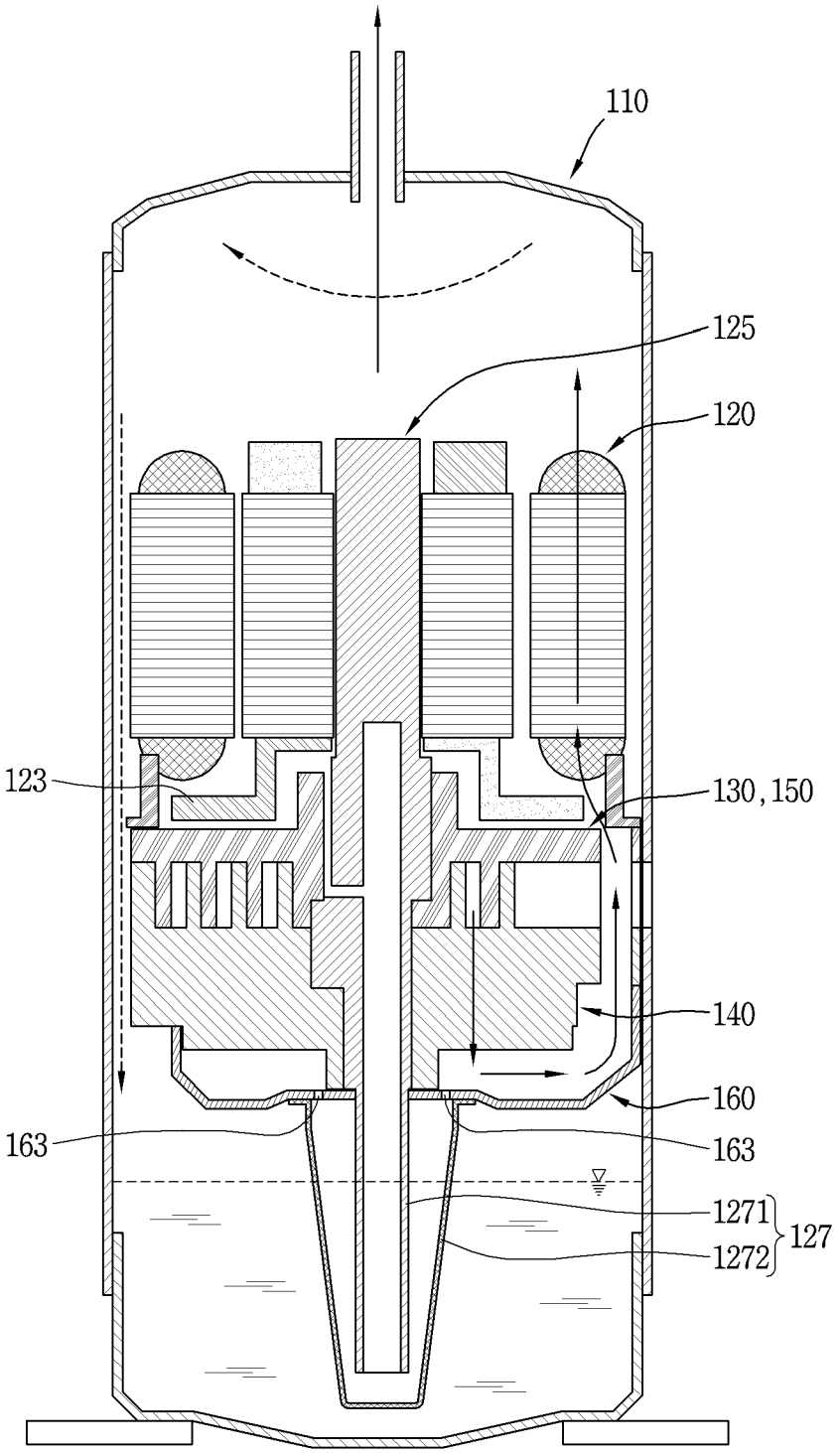
FIG. 4 is a sectional view illustrating one example of a flow of refrigerant in the scroll compressor according to the present disclosure.
Figure 5A:
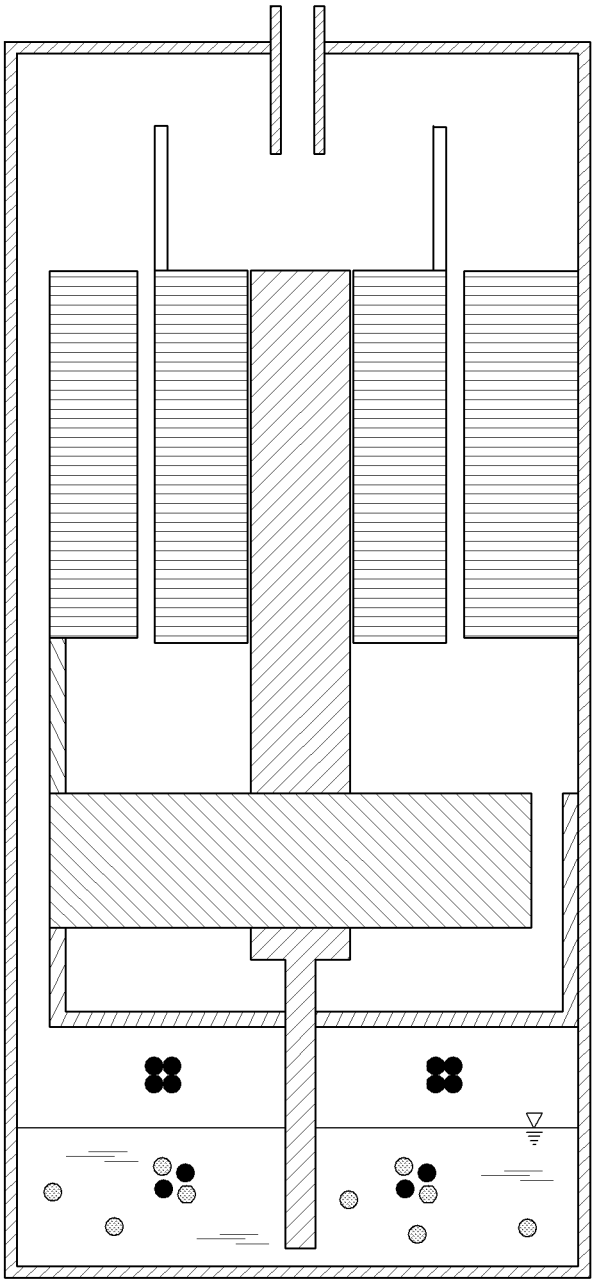
FIG. 5A is a conceptual diagram illustrating oil and refrigerant before turning on a scroll compressor according to the related art.
Figure 5B:
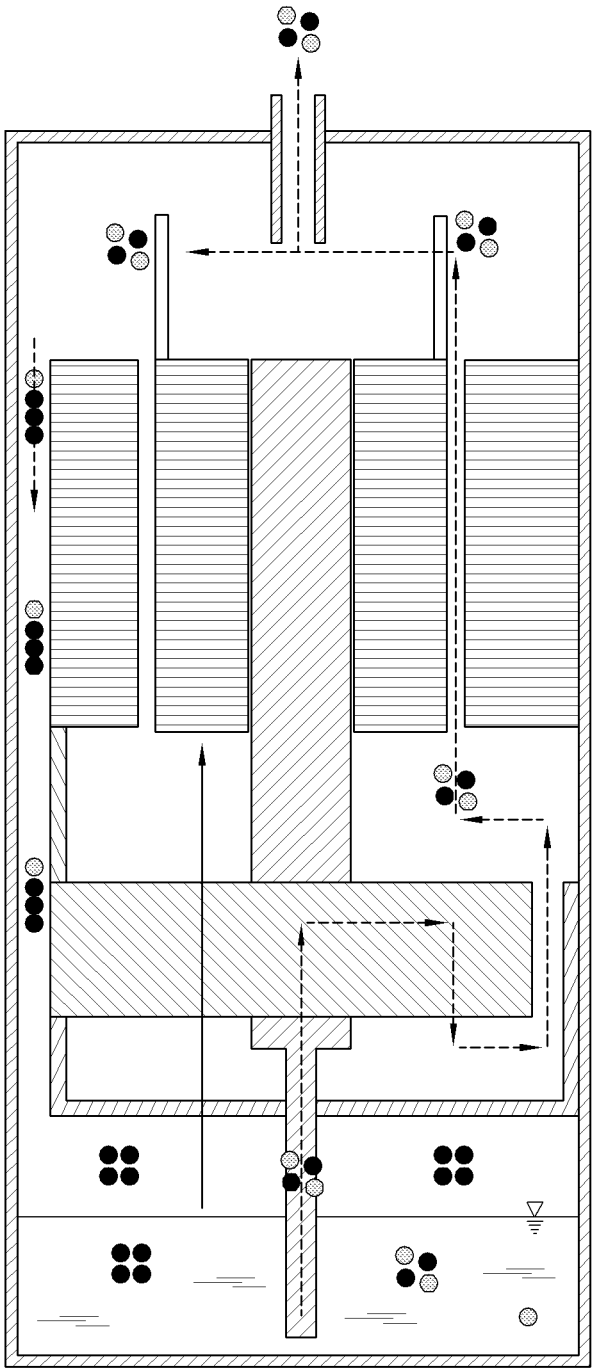
FIG. 5B is a conceptual diagram illustrating oil and refrigerant right after turning on the related art scroll compressor.
Figure 5C:
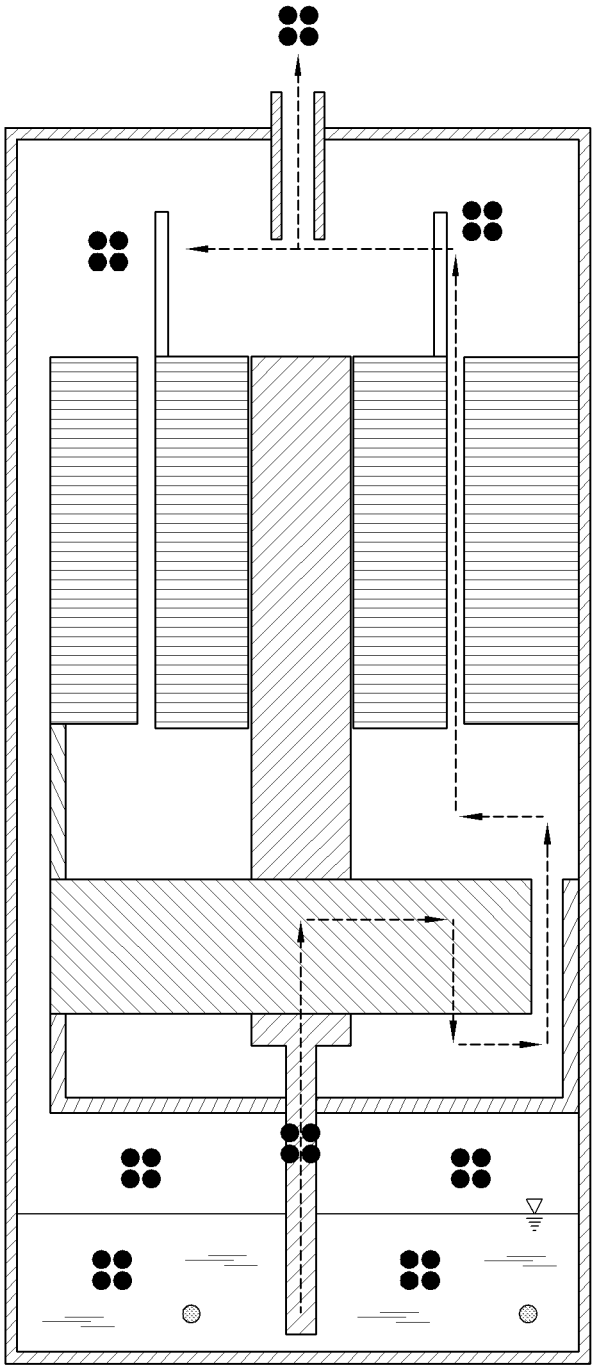
FIG. 5C is a conceptual diagram illustrating a state just before securing oil superheat in the related art scroll compressor.

FIG. 3 is a conceptual diagram illustrating a flow of lubricating oil in the rotating shaft and the compression part in the scroll compressor according to the present disclosure, FIG. 4 is a sectional view illustrating one example of a flow of refrigerant in the scroll compressor according to the present disclosure, FIG. 5A is a conceptual diagram illustrating oil and refrigerant before turning on a related art scroll compressor, and FIG. 5B is a conceptual diagram illustrating oil and refrigerant right after turning on the related art scroll compressor. Also, FIG. 5C is a conceptual diagram illustrating a state just before securing oil superheat in the related art scroll compressor.

Hereinafter, a description will be given of a flow of oil and refrigerant in the scroll compressor 10 and states before and immediately after turning on the related art scroll compressor, and a state immediately before securing oil superheat of the related art scroll compressor, with reference to FIGS. 3 to 5C.

FIG. 3 illustrates an example of the scroll compressor 10 of the present disclosure, in which oil for lubricating a sliding part between the rotating shaft 125 and the compression part is used, and the lubricating oil is suctioned from the oil storage space S11 to be supplied to bearings 171, 172, 173 disposed between each of the orbiting scroll 150, the fixed scroll 140, and the main frame 130 and the rotating shaft 125, and the compression part.

In particular, in the example of FIG. 3, oil supplied through an internal oil passage 1261 of the rotating shaft 125 is supplied to the compression part through a first main oil feeding passage 1326*a* and a second main oil feeding passage 1326*b* provided in the main frame 130, and a first fixed oil feeding passage 1426*a*, a second main oil feeding passage 1426*b*, and a third main oil feeding passage 1426*c* provided in the fixed scroll 140.

The scroll compressor 10 of the present disclosure has a differential pressure oil feeding structure for feeding oil of high pressure through the rotating shaft 125.

In addition, FIG. 4 illustrates a flow of refrigerant discharged from the compression part. Refrigerant discharged from a compression chamber toward the discharge cover 160 is moved to an upper side of the casing 110 to flow out of the casing 110 through the refrigerant discharge pipe 116. The refrigerant also contains some oil supplied to the compression unit in FIG. 3. Oil separated in the inner space provided at an upper side within the casing 110 flows into the oil storage space S11 through an oil return groove 1211*b* and is accommodated therein.

In addition, as will be described later, a discharge hole 163 is formed in a cover bottom surface 1611 of the discharge cover 160, and some of the refrigerant discharged from the compression chamber are supplied into the oil storage space S11 through the discharge hole 163. This can result in adjusting temperature of oil.

On the other hand, FIG. 5A illustrates an example in which oil and refrigerant exist in the oil storage space S11 before starting the operation of the compressor. Some of the refrigerant in the oil storage space S11 are mixed with stacked oil and the other refrigerant is on the top of the oil.

Also, immediately after starting the operation of the compressor, liquid refrigerant in a low-viscosity state without securing discharge superheat is accumulated in the compression part of the compressor. This example is illustrated in FIG. 5B. Immediately after the compressor is turned on, liquid refrigerant is mixed in a saturated low-viscosity state with oil of low temperature. This oil may cause damages on bearings between each of the orbiting scroll, the fixed scroll, and the main frame and the rotating shaft, and lowering of an oil level.

In addition, FIG. 5C illustrates a state that oil is heated in response to the turn-on of the compressor but oil superheat has not been secured yet. In this state, an amount of oil is reduced due to evaporation of oil droplets and thereby an oil level is lowered.

The fixed scroll 140 is disposed inside the casing 110. The orbiting scroll 150 is disposed on one side of the fixed scroll 140 to be pivotable, and the fixed scroll 140 forms a compression chamber together with the orbiting scroll 150.

In addition, the discharge cover 160 is disposed on another side of the fixed scroll 140, opposite to the one side.

The fixed scroll 140 includes a fixed wrap 144. The fixed scroll 140 may further include a sub bearing hole 1431.

The fixed scroll 140 may include a fixed end plate 141, a fixed side wall 142, a sub bearing portion 143, and a fixed wrap 144. A detailed structure of the fixed scroll 140 will be described later.

The orbiting scroll 150 performs an orbiting motion relative to the fixed scroll 140, and is engaged with the fixed wrap 144 to form the compression chamber.

For example, the orbiting scroll 150 may include an orbiting wrap 152 engaged with the fixed wrap 144 of the fixed scroll 140 to form a compression chamber, and an orbiting end plate 151 connected at one end of the orbiting wrap 152 and having a predetermined width. A detailed description of the orbiting scroll 150 will be described later.

The rotating shaft 125 may be disposed inside the casing 110 in one direction and disposed on inner circumferences of the fixed scroll 140 and the orbiting scroll 150 to transfer rotational force to enable the orbiting scroll 150 to perform the orbiting motion.

The discharge cover 160 is coupled to the another side of the fixed scroll 140, which is opposite to the one side thereof forming the compression chamber. The discharge cover 160 also has a cover bottom surface 1611 defining a lower portion of the discharge cover 160.

A discharge hole 163 is formed through the cover bottom surface 1611.

The oil feeder 127 is coupled to the cover bottom surface 1611 to face an opposite direction to the fixed scroll 140, so as to communicate with the oil storage space S11.

The discharge hole 163 is formed through a portion of the cover bottom surface 1611. The portion is located at an inner side of an inner circumference of the oil feeder 127. As the discharge hole 163 is formed through the portion of the cover bottom surface 1611 located at the inner side of the inner circumference of the oil feeder 127, it can communicate with an inside of the oil feeder 127.

In the related art compressor in which suction and discharge refrigerant pipes are disposed in the oil storage space S11 to cool or heat oil, the oil is left in low temperature or oil superheat is not secured at the beginning of operation, which causes the oil to flow in a low-viscosity state. In particular, when the oil flows in the low-viscosity state, bearings in the compressor may be damaged and an oil level may be lowered.

The scroll compressor 10 of the present disclosure can adjust temperature of oil without using a pipe, and refrigerant collected in the discharge space S3 is moved to the oil storage space S11 through the discharge hole 163. Accordingly, oil in the oil storage space S11 can be directly in contact with discharge refrigerant and stirred, and the temperature of the oil in the oil storage space S11 can be increased more rapidly at the beginning of the operation of the scroll compressor 10.

In addition, as the discharge hole 163 of the discharge cover 160 is formed through the cover bottom surface 1611 located at the inner side of the oil feeder 127, scattering of oil due to injected refrigerant can be reduced while adjusting the temperature of the oil in the oil storage space S11.

A more detailed structure in which the discharge hole 163 is formed through the lower surface of the cover bottom surface 1611 to communicate with the inner side of the oil feeder 127, so as to obtain the aforementioned effects will be described later.

Referring to FIG. 1, a high-pressure and bottom-compression type scroll compressor 10 (hereinafter, referred to as a scroll compressor 10) according to an implementation includes a driving motor 120 constituting a motor unit disposed in an upper portion of a casing 110, and a main frame 130, a fixed scroll 140, an orbiting scroll 150, and a discharge cover 160 sequentially disposed below the driving motor 120. In general, the driving motor 120 constitutes a motor part, and the main frame 130, the fixed scroll 140, the orbiting scroll 150, and the discharge cover 160 constitutes a compression part.

The motor part is coupled to an upper end of a rotating shaft 125 to be explained later, and the compression part is coupled to a lower end of the rotating shaft 125. Accordingly, the compressor has the bottom-compression type structure described above, and the compression part is connected to the motor part by the rotating shaft 125 to be operated by a rotational force of the motor part.

Referring to FIG. 1, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111.

Accordingly, the inner space 110*a* of the casing 110 is sealed. The sealed inner space 110*a* of the casing 110 is divided into a lower space S1 and an upper space S2 based on the driving motor 120.

The lower space S1 is a space defined below the driving motor 120. The lower space S1 may be further divided into an oil storage space S11 and an outflow space S12 with the compression unit therebetween.

The oil storage space S11 may be a space defined below the compression part to store oil or mixed oil in which liquid refrigerant is contained. The outflow space S12 is a space defined between an upper surface of the compression part and a lower surface of the driving motor 120. Refrigerant compressed in the compression part or mixed refrigerant in which oil is contained is discharged into the outflow space S12.

The upper space S2 is a space defined above the driving motor 120 to form an oil separating space in which oil is separated from refrigerant discharged from the compression part. A refrigerant discharge pipe 116 communicates with the upper space S2.

The driving motor 120 and the main frame 130 may be fixedly inserted into the cylindrical shell 111. An outer circumferential surface of the driving motor 120 and an outer circumferential surface of the main frame 130 may be respectively provided with an oil return passages Po1 and Po2 each spaced apart from an inner circumferential surface of the cylindrical shell 111 by a predetermined distance. This will be described again later together with an oil return passage.

A refrigerant suction pipe 115 is coupled through a side surface of the cylindrical shell 111. Accordingly, the refrigerant suction pipe 115 is coupled through the cylindrical shell 111 forming the casing 110 in a radial direction.

The refrigerant suction pipe 115 is formed in an L-like shape. One end of the refrigerant suction pipe 115 is inserted through the cylindrical shell 111 to directly communicate with a suction port 1421 of the fixed scroll 140, which configures the compression part. Accordingly, refrigerant can be introduced into a compression chamber V through the refrigerant suction pipe 115.

Another end of the refrigerant suction pipe 115 is connected to an accumulator which defines a suction passage outside the cylindrical shell 111. The accumulator is connected to an outlet side of the evaporator through a refrigerant pipe. Accordingly, while refrigerant flows from the evaporator to the accumulator, liquid refrigerant is separated in the accumulator, and only gaseous refrigerant is directly introduced into the compression chamber V through the refrigerant suction pipe 115.

A terminal bracket may be coupled to an upper portion of the cylindrical shell 111 or the upper shell 112, and a terminal for transmitting external power to the driving motor 120 may be coupled through the terminal bracket.

An inner end 116*a* of the refrigerant discharge pipe 116 is coupled through an upper portion of the upper shell 112 to communicate with the inner space 110*a* of the casing 110, specifically, the upper space S2 defined above the driving motor 120.

The refrigerant discharge pipe 116 corresponds to a passage through which compressed refrigerant discharged from the compression part to the inner space 110*a* of the casing 110 is exhausted toward a condenser. The refrigerant discharge pipe 116 may be disposed coaxially with the rotating shaft 125 to be described later. Accordingly, a venturi tube 191 disposed in parallel with the refrigerant discharge pipe 116 may be eccentrically disposed with respect to an axial center of the rotating shaft 125.

The refrigerant discharge pipe 116 may be provided therein with an oil separator for separating oil from refrigerant discharged from the compressor 10 to the condenser, or a check valve for suppressing refrigerant discharged from the compressor 10 from flowing back into the compressor 10.

One end portion of an oil circulation tube may be coupled through a lower end portion of the lower shell 113. Both ends of the oil circulation tube may be open, and another end portion of the oil circulation tube may be coupled through the refrigerant suction pipe 115. An oil circulation valve may be installed in a middle portion of the oil circulation tube.

The oil circulation valve may be open or closed according to an amount of oil stored in the oil storage space S11 or according to a set condition. For example, the oil circulation valve may be open to circulate oil stored in the oil storage space S11 to the compression part through the refrigerant suction pipe 115 at the beginning of the operation of the compressor, while being closed to prevent an excessive outflow of oil within the compressor during a normal operation.

Hereinafter, the driving motor 120 constituting the motor part will be described with reference to FIG. 2. The driving motor 120 according to this implementation includes a stator 121 and a rotor 122. The stator 121 is fixedly fitted onto the inner circumferential surface of the cylindrical shell 111, and the rotor 122 is rotatably disposed in the stator 121.

The stator 121 includes a stator core 1211 and a stator coil 1212.

The stator core 1211 is formed in an annular shape or a hollow cylindrical shape and is shrink-fitted onto the inner circumferential surface of the cylindrical shell 111.

A rotor accommodating portion 1211*a* is formed in a circular shape through a central portion of the stator core 1211 such that the rotor 122 can be rotatably inserted therein. A plurality of stator-side return grooves 1211*b* may be recessed or cut out in a D-cut shape at an outer circumferential surface of the stator core 1211 along the axial direction and disposed at preset distances along a circumferential direction.

A plurality of teeth and slots are alternately formed on an inner circumferential surface of the rotor accommodating portion 1211*a* in the circumferential direction, and the stator coil 1212 is wound on each tooth by passing through the slots at both sides of the tooth.

More precisely, the slots may be spaces between neighboring stator coils in the circumferential direction. In addition, the slot defines an inner passage 120*a*, an air gap passage is defined between the inner circumferential surface of the stator core 1211 and an outer circumferential surface of a rotor core 1221 to be described later, and an oil return groove 1211*b* defines an external passage. The inner passages 120*a* and the air gap passage define a passage through which refrigerant discharged from the compression part moves to the upper space S2, and the external passage defines a first oil return passage Po1 through which oil separated in the upper space S2 is returned to the oil storage space S11.

The stator coil 1212 is wound around the stator core 1211 and electrically connected to an external power source through a terminal that is coupled through the casing 110. An insulator 1213, which is an insulating member, is inserted between the stator core 1211 and the stator coil 1212.

The insulator 1213 may be provided at an outer circumferential side and an inner circumferential side of the stator coil 1212 to accommodate a bundle of the stator coil 1212 in the radial direction, and may extend to both sides in the axial direction of the stator core 1211.

The rotor 122 includes a rotor core 1221 and permanent magnets 1222.

The rotor core 1221 is formed in a cylindrical shape to be accommodated in a rotor accommodating portion 1211*a* defined in the central portion of the stator core 1211.

Specifically, the rotor core 1221 is rotatably inserted into the rotor accommodating portion 1211*a* of the stator core 1211 with a predetermined gap 120*a* therebetween. The permanent magnets 1222 are embedded in the rotor core 1221 at preset distances along the circumferential direction.

A balance weight 123 may be coupled to a lower end of the rotor core 1221. Alternatively, the balance weight 123 may be coupled to a main shaft portion 1251 of the rotating shaft 125 to be described later. This implementation will be described based on an example in which the balance weight 123 is coupled to a lower end of the rotor core 1221.

In addition, the balance weight 123 is coupled to the lower end of the rotor core 1221 and rotates in response to rotation of the rotor 122.

A gas drain hole 190 for resolving differential pressure in a lower portion due to the discharge hole 163 may be formed in an inner circumference of the balance weight 123, and a detailed structure thereof will be described later.

The rotating shaft 125 is coupled to the center of the rotor core 1221. An upper end portion of the rotating shaft 125 is press-fitted to the rotor 122, and a lower end portion of the rotating shaft 125 is rotatably inserted into the main frame 130 to be supported in the radial direction.

An air gap or a winding gap through which discharge refrigerant can flow may be defined in the rotor 122.

The main frame 130 is provided with a main bearing 171 configured as a bush bearing to support the lower end portion of the rotating shaft 125. Accordingly, a portion, which is inserted into the main frame 130, of the lower end portion of the rotating shaft 125 can smoothly rotate inside the main frame 130.

The rotating shaft 125 transfers rotational force of the driving motor 120 to the orbiting scroll 150 constituting the compression part. Accordingly, the orbiting scroll 150 eccentrically coupled to the rotating shaft 125 may perform an orbiting motion with respect to the fixed scroll 140.

Referring to FIG. 2, the rotating shaft 125 according to the implementation includes a main shaft portion 1251, a first bearing portion 1252, a fixed bearing portion 1253, and an eccentric portion 1254.

The main shaft portion 1251 is an upper portion of the rotating shaft 125 and formed in a cylindrical shape. The main shaft portion 1251 may be partially press-fitted to the stator core 1211.

The first bearing portion 1252 is a portion extending from a lower end of the main shaft portion 1251. The first bearing portion 1252 may be inserted into a main bearing hole 1331 of the main frame 130 so as to be supported in the radial direction.

The fixed bearing portion 1253 indicates a lower portion of the rotating shaft 125. The fixed bearing portion 1253 may be inserted into a sub bearing hole 143*a* of a fixed scroll 140 so as to be supported in the radial direction. A central axis of the fixed bearing portion 1253 and a central axis of the first bearing portion 1252 may be aligned on the same line. That is, the first bearing portion 1252 and the fixed bearing portion 1253 may have the same central axis.

Meanwhile, a fixed bearing 172 coupled to the inner circumference of the fixed scroll 140 is press-fitted to an outer circumference of the fixed bearing portion 1253.

An eccentric portion 1254 is formed between a lower end of the first bearing portion 1252 and an upper end of the fixed bearing portion 1253. The eccentric portion 1254 may be inserted into a rotating shaft coupling portion 153 of the orbiting scroll 150 to be described later.

The eccentric portion 1254 may be eccentric with respect to the first bearing portion 1252 and the fixed bearing portion 1253 in the radial direction. That is, a central axis of the eccentric portion 1254 may be eccentric with respect to the central axis of the first bearing portion 1252 and the central axis of the fixed bearing portion 1253. Accordingly, when the rotating shaft 125 rotates, the orbiting scroll 150 can perform an orbiting motion with respect to the fixed scroll 140.

On the other hand, an oil feeding passage 126 for feeding oil to the first bearing portion 1252, the fixed bearing portion 1253, and the eccentric portion 1254 may be formed in a hollow shape inside the rotating shaft 125. The oil feeding passage 126 may include an inner oil passage 1261 defined in the rotating shaft 125 along the axial direction.

As the compression part is located below the motor part 120, the inner oil passage 1261 may be formed in a grooving manner from the lower end of the rotating shaft 125 approximately to a lower end or a middle height of the stator 121 or up to a position higher than an upper end of the first bearing portion 1252. Although not illustrated, the inner oil passage 1261 may alternatively be formed through the rotating shaft 125 in the axial direction.

An oil feeder 127 for pumping up oil filled in the oil storage space S11 may be coupled to the lower end of the rotating shaft 125, namely, a lower end of the fixing bearing portion 1253. The oil feeder 127 may include an oil feeding pipe 1271 inserted into the inner oil passage 1261 of the rotating shaft 125, and a blocking member 1272 accommodating the oil feeding pipe 1271 to block an introduction of foreign materials. The oil feeding pipe 1271 may extend downward through the discharge cover 160 to be immersed in the oil filled in the oil storage space S11.

The rotating shaft 125 may be provided with a plurality of oil feeding holes that communicate with the inner oil passage 1261 to guide oil moving upward along the inner oil passage 1261 to flow toward the first bearing portion 1252, the fixed bearing portion 1253, and the eccentric portion 1254.

Referring to FIG. 2, an example in which the compression part according to the implementation includes the main frame 130, the fixed scroll 140, the orbiting scroll 150, the discharge cover 160, and the oil feeder 127 is illustrated.

The main frame 130 is fixedly disposed on an opposite side of the fixed scroll 140 with the orbiting scroll 150 interposed therebetween. In addition, the main frame 130 may accommodate the orbiting scroll 150 to perform an orbiting motion.

Figure 6:
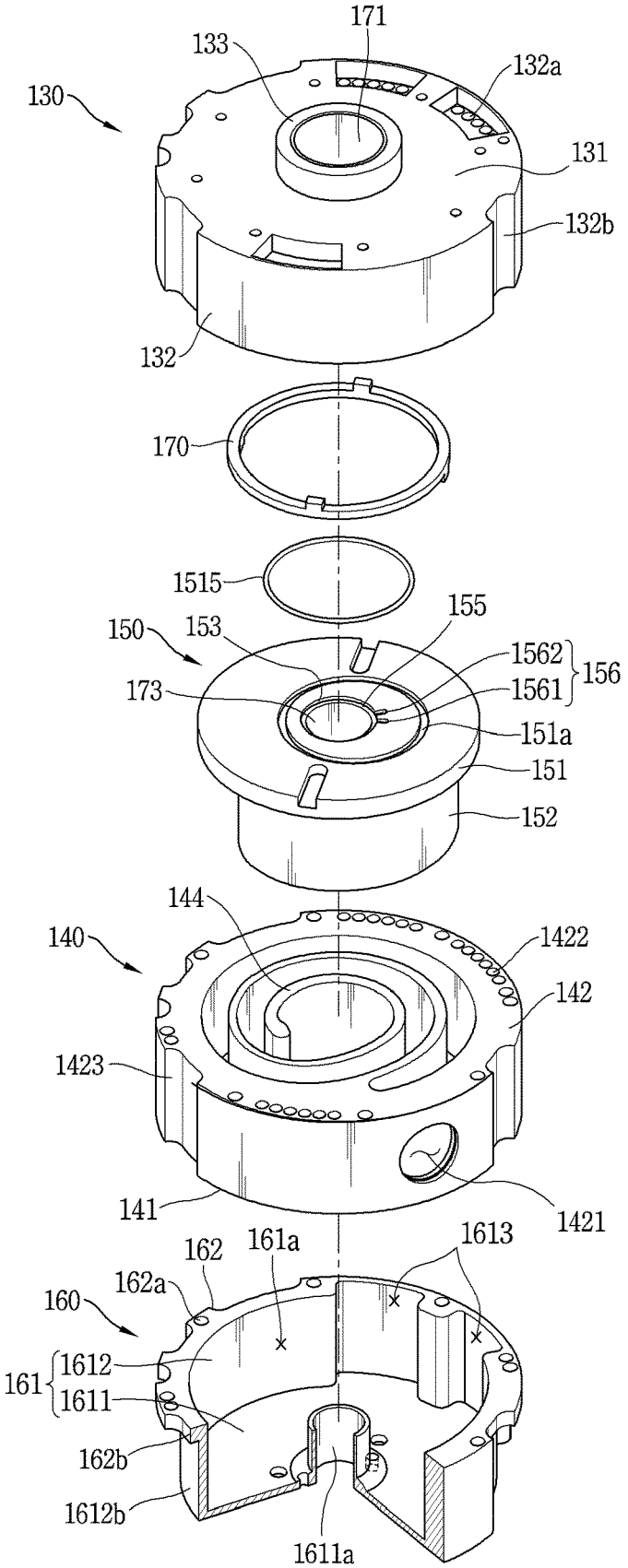
FIG. 6 is an exploded perspective view illustrating a compression part.
Figure 7:
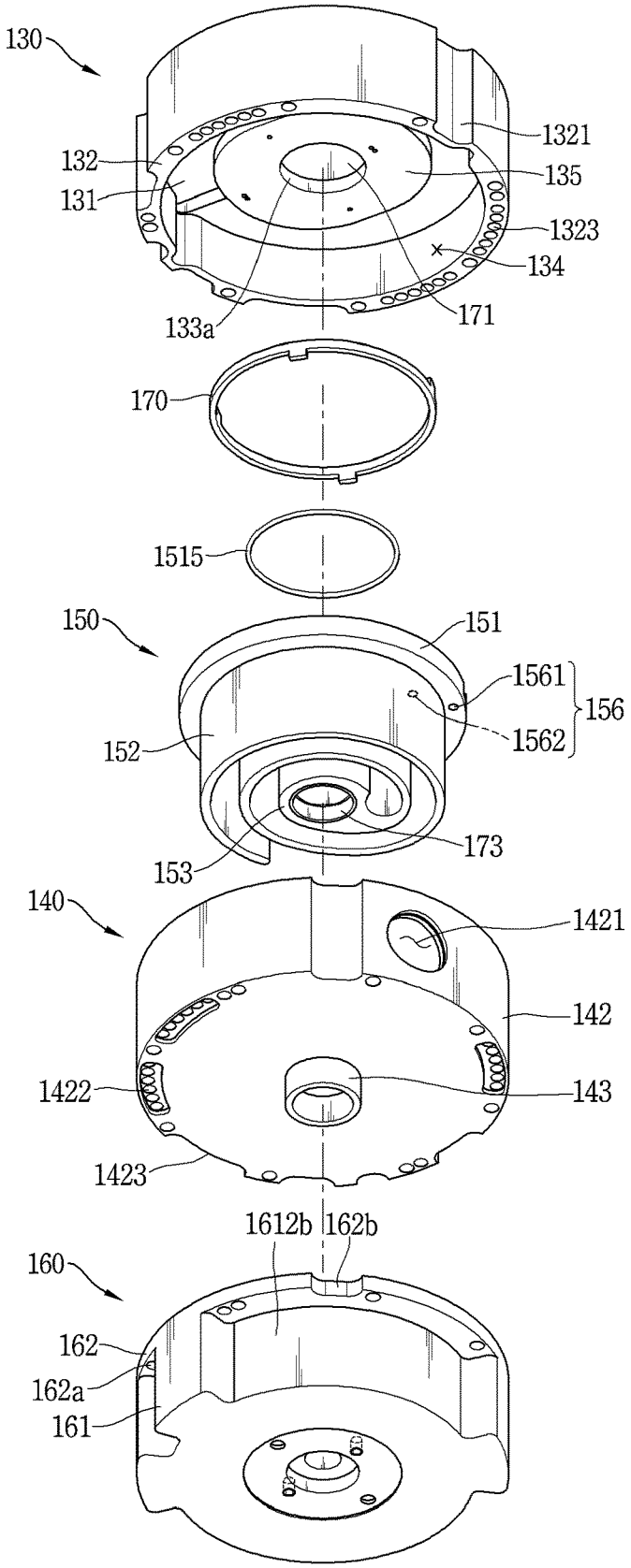
FIG. 7 is an exploded perspective view of the compression part of FIG. 6, viewed from the bottom.

Referring to FIGS. 6 and 7, the main frame 130 may include a frame end plate 131, a frame side wall 132, and a main bearing accommodating portion 133.

The frame end plate 131 is formed in an annular shape and disposed below the driving motor 120. The frame side wall 132 may extend in a cylindrical shape from a rim of a lower surface of the main frame 130. For example, the frame side wall 132 extends in a cylindrical shape from a rim of a lower surface of the frame end plate 131. An outer circumferential surface of the frame side wall 132 is fixed to an inner circumferential surface of the cylindrical shell 111 in a shrink-fitting manner or welding manner. Accordingly, the oil storage space S11 and the outflow space S12 constituting the lower space S1 of the casing 110 can be separated from each other by the frame end plate 131 and the frame side wall 132.

A second outflow hole 1321 defining a part of an outflow passage may be formed through the frame side wall 132 in the axial direction. The second outflow hole 1321 is formed to correspond to a first outflow hole 1422 of the fixed scroll 140 to be described later, to define a refrigerant outflow passage (no reference numeral given) together with the first outflow hole 1422.

As illustrated in FIGS. 6 and 7, the second outflow hole 1321 may be elongated in the circumferential direction, or may be provided in plurality disposed at preset distances along the circumferential direction. Accordingly, the second outflow hole 1321 can secure a volume of a compression chamber relative to the same diameter of the main frame 130 by maintaining a minimum radial width with securing a discharge area. This may equally be applied to the first outflow hole 1422 that is formed in the fixed scroll 140 to define a part of the outflow passage.

An outflow guide groove 1322 to accommodate the plurality of second outflow holes 132*a* may be formed in an upper end of the second outflow hole 1321, namely, an upper surface of the frame end plate 131. At least one outflow guide groove 1322 may be formed according to positions of the second outflow holes 1321. For example, when the second outflow holes 1321 form three groups, the number of outflow guide grooves 1322 may be three to accommodate the three groups of second outflow holes 1321, respectively. The three outflow guide grooves 1322 may be located on the same line in the circumferential direction.

The outflow guide groove 1322 may be formed wider than the second outflow hole 1321. For example, the second outflow hole 1321 may be formed on the same line in the circumferential direction together with a first oil return groove 1323 to be described later. Therefore, when a flow path guide 180 to be described later is provided, the second outflow hole 1321 having a small cross-sectional area may be difficult to be located at an inner side of the flow path guide 180. With this reason, the outflow guide groove 1322 may be formed at an end portion of the second outflow hole 1321 while an inner circumferential side of the outflow guide groove 1322 extends radially up to the inner side of the flow path guide 180.

Accordingly, the second outflow hole 1321 can be located adjacent to the outer circumferential surface of the main frame 130 by reducing an inner diameter of the second outflow hole 1321, and simultaneously can be prevented from being located at an outer side of the flow path guide 180, namely, adjacent to the outer circumferential surface of the stator 121.

A frame oil return groove (hereinafter, first oil return groove 1211*b*) 1323 that defines a part of a second oil return passage Po2 may be formed axially through an outer circumferential surface of the frame end plate 131 and an outer circumferential surface of the frame side wall 132 that define the outer circumferential surface of the main frame 130. The first oil return groove 1323 may be provided by only one or may be provided in plurality disposed in the outer circumferential surface of the main frame 130 at preset distances in the circumferential direction. Accordingly, the outflow space S12 of the casing 110 can communicate with the oil storage space S11 of the casing 110 through the first oil return groove 1323.

The first oil return groove 1323 is formed to correspond to a scroll oil return groove (hereinafter, second oil return groove 1211*b*) 1423 of the fixed scroll 140, which will be described later, and defines a second oil return passage together with the second oil return groove 1423 of the fixed scroll 140.

The main bearing accommodating portion 133 protrudes upward from an upper surface of a central portion of the frame end plate 131 toward the driving motor 120. The main bearing accommodating portion 133 is provided with a main bearing hole 1331 formed therethrough in a cylindrical shape along the axial direction. The first bearing portion 1252 of the rotating shaft 125 is inserted into the main bearing hole 1331 to be supported in the radial direction.

Hereinafter, the fixed scroll 140 will be described with reference to FIGS. 2 and 6. The fixed scroll 140 according to the implementation may include a fixed end plate 141, a fixed side wall 142, a sub bearing portion 143, and a fixed wrap 144.

The fixed end plate 141 may be formed in a disk shape having a plurality of concave portions on an outer circumferential surface thereof, and a sub bearing hole 1431 defining the sub bearing portion 143 to be described later may be formed through a center of the fixed end plate 141 in the vertical direction. Discharge ports 1411 and 1412 may be formed around the sub bearing hole 1431. The discharge ports 1411 and 1412 may communicate with a discharge pressure chamber Vd so that compressed refrigerant is moved into the outflow space S12 of the discharge cover 160 to be explained later.

Although not illustrated, only one discharge port may be provided to communicate with both of a first compression chamber V1 and a second compression chamber V2 to be described later. In the implementation, however, a first discharge port (no reference numeral given) may communicate with the first compression chamber V1 and a second discharge port (no reference numeral given) may communicate with the second compression chamber V2. Accordingly, refrigerants compressed in the first compression chamber V1 and refrigerant compressed in the second compression chamber V2 can be independently discharged through the different discharge ports.

The fixed side wall 142 may extend in an annular shape from an edge of an upper surface of the fixed end plate 141 in the vertical direction. The fixed side wall 142 may be coupled to face the frame side wall 132 of the main frame 130 in the vertical direction.

A first outflow hole 1422 may be formed through the fixed side wall 142 in the axial direction. The first outflow hole 1422 may be elongated in the circumferential direction or may be provided in plurality disposed at preset distances along the circumferential direction. Accordingly, the first outflow hole 1422 can secure a volume of a compression chamber relative to the same diameter of the fixed scroll 140 by maintaining a minimum radial width with securing a discharge area.

The first outflow hole 1422 communicates with the second outflow hole 1321 in a state in which the fixed scroll 140 is coupled to the cylindrical shell 111. Accordingly, the first outflow hole 1422 can define a refrigerant outflow passage together with the second outflow hole 1321.

A second oil return groove 1423 may be formed in an outer circumferential surface of the fixed side wall 142. The second oil return groove 1423 communicates with the first oil return groove 1323 provided at the main frame 130 to guide oil returned along the first oil return groove 1323 to the oil storage space S11. Accordingly, the first oil return groove 1323 and the second oil return groove 1423 define the second oil return passage Po2 together with an oil return groove 1612*b* of the discharge cover 160 to be described later.

The fixed side wall 142 is provided with a suction port 1421 formed through the fixed side wall 142 in the radial direction. An end portion of the refrigerant suction pipe 115 inserted through the cylindrical shell 111 is inserted into the suction port 1421. Accordingly, refrigerant can be introduced into a compression chamber V through the refrigerant suction pipe 115.

The sub bearing portion 143 extends in the axial direction from a central portion of the fixed end plate 141 toward the discharge cover 160. A sub bearing hole 1431 having a cylindrical shape may be formed through a center of the sub bearing portion 143 in the axial direction, and the fixing bearing portion 1253 of the rotating shaft 125 may be inserted into the sub bearing hole 1431 to be supported in the radial direction. Therefore, the lower end (or the fixed bearing portion) of the rotating shaft 125 can be radially supported by being inserted into the sub bearing portion 143 of the fixed scroll 140, and the eccentric portion 1254 of the rotating shaft 125 can be supported in the axial direction by an upper surface of the fixed end plate 141 defining a periphery of the sub bearing portion 143.

The fixed wrap 144 may extend from the upper surface of the fixed end plate 141 toward the orbiting scroll 150 in the axial direction. The fixed wrap 144 is engaged with an orbiting wrap 152 to be described later to define the compression chamber V. The fixed wrap 144 will be described later together with the orbiting wrap 152.

Hereinafter, the orbiting scroll 150 will be described with reference to FIGS. 6 and 7. Specifically, the orbiting scroll 150 according to this implementation may include an orbiting end plate 151, an orbiting wrap 152, and a rotating shaft coupling portion 153.

The orbiting end plate 151 is formed in a disk shape and accommodated in the main frame 130. An upper surface of the orbiting end plate 151 may be supported in the axial direction by the main frame 130 with interposing a back pressure sealing member (no reference numeral given) therebetween.

The orbiting wrap 152 may extend from a lower surface of the orbiting end plate 151 toward the fixed scroll 140. The orbiting wrap 152 is engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape.

For example, the orbiting wrap 152 may be formed in a substantially elliptical shape in which a plurality of arcs having different diameters and origins are connected and the outermost curve may have a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric portion 1254 of the rotating shaft 125 is rotatably inserted into the rotating shaft coupling portion 153. An outer circumferential part of the rotating shaft coupling portion 153 is connected to the orbiting wrap 152 to define the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion 1254 of the rotating shaft 125 overlaps the orbiting wrap 152 on the same plane. Accordingly, repulsive force and compressive force of refrigerant can cancel each other while being applied to the same plane based on the orbiting end plate 151, and thus inclination of the orbiting scroll 150 due to interaction between the compressive force and the repulsive force can be suppressed.

The rotating shaft coupling portion 153 may include a coupling side portion that is in contact with an outer circumference of an orbiting bearing 173 to support the orbiting bearing 173.

In addition, the rotating shaft coupling portion 153 may further include a coupling end portion that is in contact with one end of the orbiting bearing 173 to support the orbiting bearing 173.

Referring to FIGS. 2 and 3, the coupling side portion is formed on an inner circumference of the rotating shaft coupling portion 153 to come in contact with an outer circumference of the orbiting bearing 173, and the coupling end portion is in contact with the upper end of the orbiting bearing 173 to support the orbiting bearing 173.

On the other hand, the compression chamber V is formed in a space defined by the fixed end plate 141, the fixed wrap 144, the orbiting end plate 151, and the orbiting wrap 152. The compression chamber V may include a first compression chamber V1 defined between an inner surface of the fixed wrap 144 and an outer surface of the orbiting wrap 152, and a second compression chamber V2 defined between an outer surface of the fixed wrap 144 and an inner surface of the orbiting wrap 152.

Hereinafter, the discharge cover 160 will be described with reference to FIGS. 2 and 6 to 10.

As described above, the discharge cover 160 has the cover bottom surface 1611. Referring to FIG. 2, etc., the example in which the cover bottom surface 1611 is disposed to be spaced apart from a bottom surface of the fixed scroll 140 is illustrated.

In addition, the discharge cover 160 may further include a cover side portion 1612 and a discharge space S3.

The cover side portion 1612 may extend from the cover bottom surface 1611 toward the fixed scroll 140.

The discharge space S3 is formed together with the lower surface of the fixed scroll 140 inside the discharge cover 160 defined by the cover bottom surface 1611 and the cover side portion 1612.

In this case, it may be understood that the cover bottom surface 1611 and the cover side portion 1612 connected thereto configures a cover housing portion 161 having the discharge space S3.

A through hole 1611*a* may be formed through a central portion of the cover bottom surface 1611 in the axial direction, and the sub bearing portion 143 that protrudes downward from the fixed end plate 141 is inserted into the through hole 1611*a*.

The cover bottom surface 1611 is spaced apart from the inner circumferential surface of the casing 110. Specifically, the cover bottom surface 1611 is spaced apart from the lower shell 113. At this time, the oil storage space S11 is defined between the cover bottom surface 1611 and the inner circumferential surface of the casing 110.

The cover side portion 1612 is formed in an annular shape by extending from the cover bottom surface 1611 toward the fixed scroll 140 in the axial direction.

The cover side portion 1612 extends outward from the outer circumferential surface of the cover housing portion 161 so as to be coupled to the lower surface of the fixed scroll 140 in a close contact manner.

In addition, at least one outflow hole accommodating groove 1613 may be formed in an inner circumferential surface of the cover side portion 1612 along the circumferential direction.

The outflow hole accommodating groove 1613 indicates a portion of the cover side portion 1612 that is recessed radially outward.

A space that is recessed radially outward due to the formation of the outflow hole accommodating groove 1613 may overlap a scroll discharge hole 142*a* of the fixed scroll 140 in the vertical direction.

An inner surface of the cover side portion 1612 excluding the outflow hole accommodating groove 1613 is brought into close contact with the outer circumferential surface of the fixed scroll 140, namely, the outer circumferential surface of the fixed end plate 141 so as to define a type of sealing part.

Side oil return grooves 1612*b* may be formed in an outer circumferential surface of the cover side portion 1612 at a preset distance in the circumferential direction.

A cover flange portion 162 may extend in a radial direction from an outer circumferential surface of a portion of the cover side portion 1612 excluding the portion having the outflow hole accommodating groove 1613. Specifically, the cover flange portion 162 extends from an outer circumferential surface of an upper side of the cover side portion 1612.

Coupling holes 162*a* for coupling the discharge cover 160 to the fixed scroll 140 with bolts may be formed through the cover flange portion 162.

A plurality of flange oil return grooves 162*b* may be formed between the coupling holes 162*a* at preset distances along the circumferential direction.

The flange oil return grooves 162*b* may be recessed radially inward (toward a center) from an outer circumferential surface of the cover flange portion 162.

Meanwhile, a discharge hole 163 and a refrigerant guide member 164 may be provided on a lower side of the discharge cover 160, and a detailed description thereof will be described later.

The cover side portion 1612 may be in close contact with the inner circumferential surface of the casing 110, and may include an oil return groove 1612*b* formed in an outer circumference in a manner that partial portions are spaced apart from each other in the circumferential direction.

As described above, the cover bottom surface 1611 includes the discharge hole 163 disposed inward by a predetermined distance from the center of the cover bottom surface 1611 so as to communicate with the inner side of the oil feeder 127.

The discharge hole 163 may have a diameter of 0.5 mm to 4 mm.

In addition, at least one discharge hole 163 may be provided.

The scroll compressor 10 of the present disclosure can adjust temperature of oil without using a pipe, and refrigerant collected in the discharge space S3 is moved to the oil storage space S11 through the discharge hole 163. Accordingly, oil in the oil storage space S11 can be directly in contact with discharge refrigerant and stirred, and the temperature of the oil in the oil storage space S11 can be increased more rapidly at the beginning of the operation of the scroll compressor 10.

In addition, as the discharge hole 163 of the discharge cover 160 is formed through the cover bottom surface 1611 located at the inner side of the oil feeder 127, scattering of oil due to injected refrigerant can be reduced while adjusting the temperature of the oil in the oil storage space S11.

The oil feeder 127 may include an oil suction pipe 1271 and a blocking member 1272.

The oil suction pipe 1271 may be coupled through the discharge cover 160. For example, the oil suction pipe 1271 may be coupled through the through hole 1611*a* of the discharge cover 160.

FIG. 2 illustrates an example in which the oil suction pipe 1271 is formed downward through the discharge cover 160. Oil of high pressure inside the oil storage space S11 is suctioned through the oil suction pipe 1271 to be supplied to each bearing 171, 172, and 173 and a compression chamber through the rotating shaft 125. The example in which the oil suctioned upward inside the rotating shaft 125 is supplied to each of the bearings 171, 172, and 173 and the compression chamber V has been given in the description of FIG. 3.

A lower portion of the oil suction pipe 1271 may be immersed in the oil of the oil storage space S11.

The blocking member 1272 accommodates the oil suction pipe 1271 to block an introduction of foreign substances.

A side portion of the blocking member 1272 may be formed in a mesh structure, for example, to filter out foreign substances.

In addition, the blocking member 1272 may be provided with a pressure reducing pin 1273. The pressure reducing pin 1273 reduces pressure of refrigerant that flows out through the discharge hole 163 of the discharge cover 160, to minimize damage to the blocking member 1272.

Figure 8:
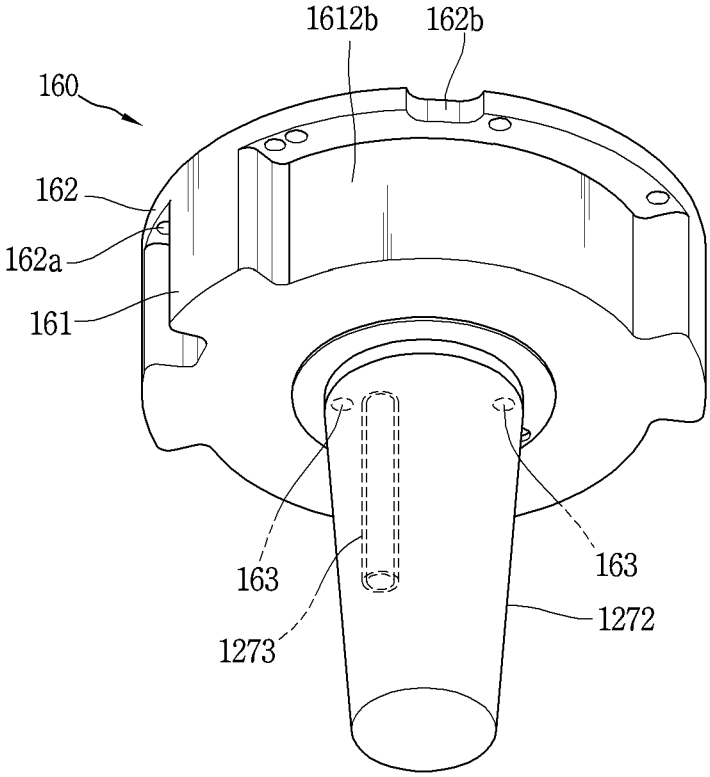
FIG. 8 is a perspective view illustrating a discharge cover and an oil feeder, viewed from the bottom.
Figure 9:
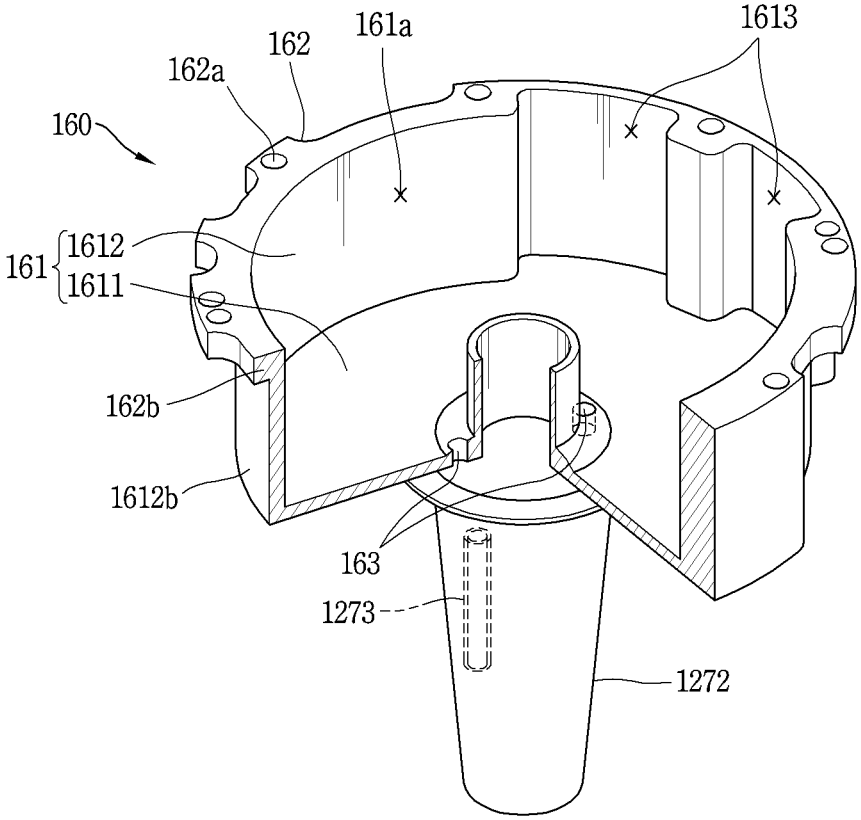
FIG. 9 is a perspective view illustrating the discharge cover and the oil feeder, viewed from the top.
Figure 10:
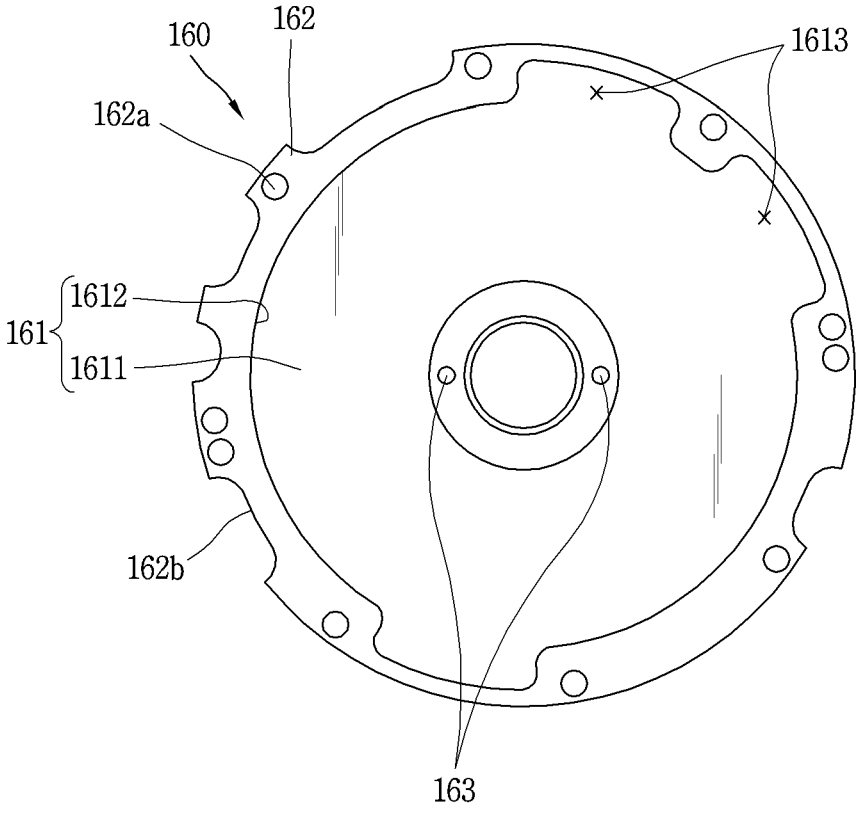
FIG. 10 is a planar view illustrating the discharge cover, viewed from the top.

As illustrated in FIGS. 8 and 9, the pressure reducing pin 1273 may be disposed in a passage through which discharge refrigerant flows in the blocking member 1272. The pressure reducing pin 1273 may have a diameter of 2 mm to 3 mm, for example.

Meanwhile, as described above, the diameter of the discharge hole 163 may be 0.5 mm to 4 mm. When the pressure reducing pin 1273 is disposed, the diameter of the discharge hole 163 may be 4 mm or more.

On the other hand, as described above, the discharge cover 160 may further includes a cover flange portion 162 that extends radially from an upper end to an outer circumference of the cover side portion 1612 to come into contact with the lower surface of the fixed scroll 140.

At least one outflow hole accommodating groove 1613 may be formed in an inner circumferential surface of the cover housing portion 161 in the circumferential direction.

The outflow hole accommodating groove 1613 may be recessed outward in the radial direction, and the first outflow hole 1422 of the fixed scroll 140 defining the outflow passage may be located inside the outflow hole accommodating groove 1613. Accordingly, an inner surface of the cover housing portion 161 excluding the outflow hole accommodating groove 1613 may be brought into close contact with an outer circumferential surface of the fixed scroll 140, namely, an outer circumferential surface of the fixed end plate 141 so as to configure a type of sealing part.

An entire circumferential angle of the outflow hole accommodating groove 1613 may be formed to be smaller than or equal to an entire circumferential angle with respect to an inner circumferential surface of the discharge space S3 except for the outflow hole accommodating groove 1613. In this manner, the inner circumferential surface of the discharge space S3 except for the outflow hole accommodating groove 1613 can secure not only a sufficient sealing area but also a circumferential length for forming the cover flange portion 162.

The cover flange portion 162 may extend radially from a portion defining the sealing part, namely, an outer circumferential surface of a portion, excluding the outflow hole accommodating groove 1613, of an upper surface of the cover side portion 1612.

The cover flange portion 162 may be provided with coupling holes 162*a* for coupling the discharge cover 160 to the fixed scroll 140 with bolts, and a plurality of oil return grooves 1621 radially recessed between adjacent coupling holes 162*a* at preset distances in the circumferential direction.

Figure 11A:
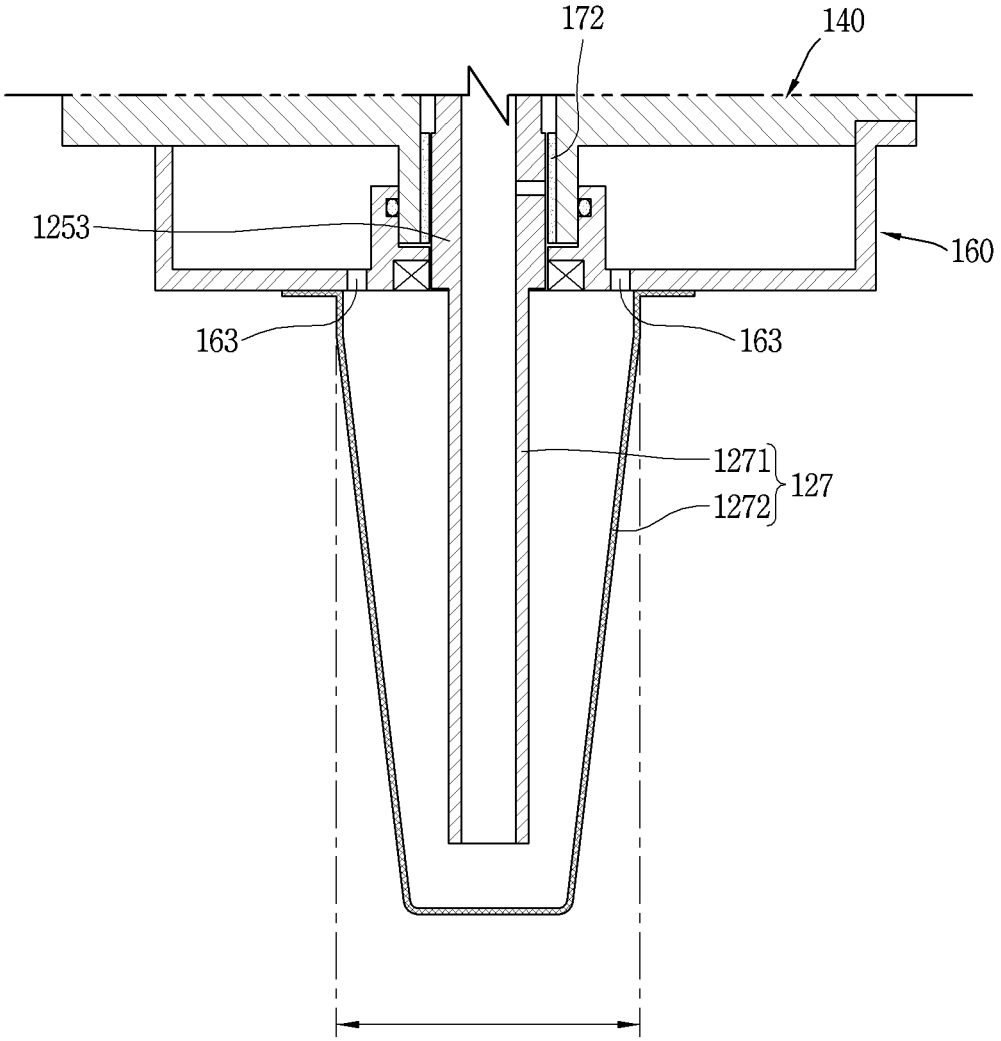
FIG. 11A is a sectional view illustrating a position at which a discharge hole is formed in the discharge cover.

FIG. 11A is a sectional view illustrating a position at which the discharge hole 163 is formed in the discharge cover 160.

In FIG. 11, an example is shown in which the discharge hole 163 communicating with the inner side of the oil feeder 127 is formed in the cover bottom surface 1611 disposed at the inner side of the inner circumference of the oil feeder 127.

Figure 11B:
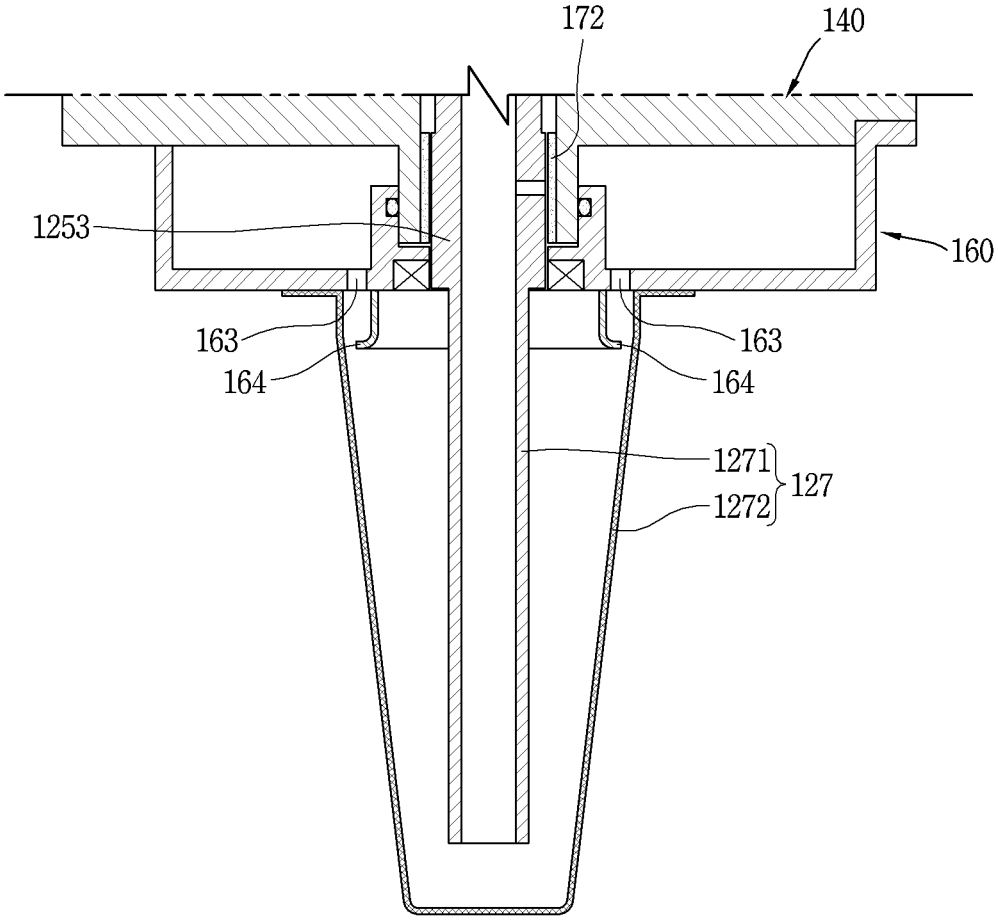
FIG. 11B is a sectional view illustrating an example in which a refrigerant guide member is provided on the discharge cover of FIG. 11 in the vicinity of the discharge hole.

FIG. 11B illustrates an example in which a refrigerant guide member is further provided on the discharge cover 160 in the vicinity of the discharge hole 163. The refrigerant guide member is provided in the discharge cover 160 to be spaced apart from the discharge hole 163, to guide a flow of refrigerant discharged through the discharge hole 163.

In one implementation, the refrigerant guide member 164 may be disposed on one side of the cover bottom surface 1611 opposite to the fixed scroll 140. In another implementation, the refrigerant guide member 164 may be disposed on an outer circumferential surface of the cover side portion 1612.

Further, the refrigerant guide member 164 may extend in a predetermined direction to guide the flow of the refrigerant in the predetermined direction.

Figure 11C:
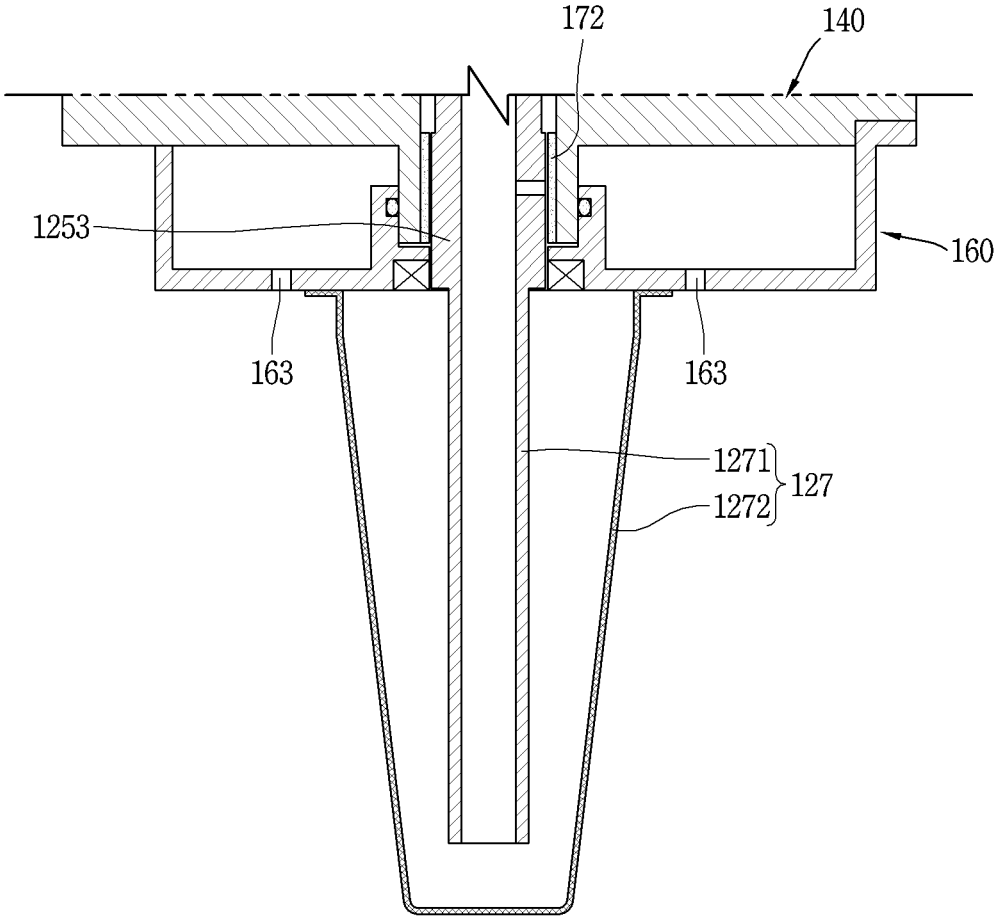
FIG. 11C is a sectional view illustrating an example in which the discharge hole is formed at another position in the discharge cover.

FIG. 11C is a sectional view illustrating an example in which the discharge hole 163 is formed at another position in the discharge cover 160. As illustrated in FIG. 11C, the discharge hole 163 may be provided in the discharge cover 160 at an outer side of an outer circumference of the oil feeder 127.

Hereinafter, a flow path guide will be described.

Referring to FIG. 2, a flow path guide 180 according to this implementation is installed between the motor part and the compression part, for example, in the outflow space S12. Specifically, the flow path guide 180 may be disposed at the upper end of the main frame 130 that faces the lower end of the driving motor 120.

The flow path guide 180 divides the outflow space S12 into a refrigerant discharge flow path and an oil return flow path. Accordingly, refrigerant that has flowed out from the compression part to the outflow space S12 may move to the upper space S2 through the inner passages 120*a* and the air gap passage. Oil separated from the refrigerant in the upper space S2 may be returned to the oil storage space S11.

The flow path guide 180 may be formed in a single annular shape or may be formed in a shape defined by a plurality of arcuate parts. Hereinafter, an example in which the flow path guide 180 is formed in a single annular shape will be mainly described, but even when it is formed in a shape defined by a plurality of arcuate parts, the basic configuration for separating refrigerant and oil and operating effects thereof may be similar.

For example, the flow path guide 180 may include a bottom portion, an outer wall portion, and an inner wall portion.

The bottom portion is formed in an annular shape and fixed to the upper surface of the main frame 130. An outflow passage cover portion may extend radially on an outer circumferential surface of the bottom portion, and may be provided with an outflow through hole that overlaps the outflow guide groove 1322 of the main frame 130.

The outer wall portion extends toward an insulator from a substantially outer circumferential surface of the bottom portion. The outer wall portion may be fitted to an inner side or outer side of the insulator 1213 to overlap the insulator 1213. The outer wall portion may be formed in an annular shape extending in the circumferential direction or may be formed in an arcuate shape.

When the outer wall portion is formed in an annular shape, a diameter of the outer wall portion may be smaller or larger than a diameter of the insulator 1213 or an upper end of the outer wall portion may be spaced apart from a lower end of the insulator 1213. Accordingly, a gap can be generated between the outer wall portion and the insulator 1213, and refrigerant (liquid refrigerant) flowing to the inside of the outer wall portion can move to an outer space S12*b*. This can allow the liquid refrigerant to quickly flow out of the compressor through a liquid refrigerant discharge unit.

Although not illustrated, when a communication path such as the gap is not formed between the annular outer wall portion and the insulator 1213, a communication groove through which an inner space S12*a* and the outer space S12*b* communicate with each other may be formed through the bottom portion or the upper surface of the main frame 130 facing the bottom portion.

The inner wall portion extends toward the insulator 1213 from a substantially inner circumferential surface of the bottom portion. The inner wall portion may extend in the axial direction or may extend by being bent to cover the balance weight 123.

As described above, since discharge refrigerant is supplied to the oil storage space S11 through the discharge hole 163 formed through the cover bottom surface 1611, differential pressure may be generated in the lower portion of the oil storage space S11. In order to resolve this, a gas drain hole 190 may be formed in a side portion and an upper portion of the compression part.

The gas drain hole 190 is provided in the compression part to relieve an increase in pressure in the oil storage space S11 due to refrigerant moving to the oil storage space S11 through the discharge hole 163. Accordingly, refrigerant can be discharged into the inner space of the casing 110 through the rotor core 1221 so as to flow out of the compressor through the refrigerant discharge pipe 116, thereby reducing pressure due to the refrigerant in the oil storage space S11.

For example, the gas drain hole 190 may include an upper communication portion 191 formed in the upper portion of the compression part, a lower communication portion 193 formed downward in a side portion of the compression part, and a middle communication portion 195 formed between the upper communication portion 191 and the lower communication portion 193 to communicate with each other.

The upper communication portion 191 may be formed in an inner circumference of the balance weight 123 such that refrigerant can flow to the upper portion of the compressor, and may be disposed between the inner circumference of the balance weight 123 and the main bearing accommodating portion 133 of the main frame 130 in a vertical direction.

The balance weight 123 is configured to rotate together with the rotor of the driving motor. As the balance weight 123 rotates, relatively low pressure is formed at the inner circumference of the balance weight 123, compared to the oil storage space S11. Accordingly, refrigerant of high pressure within the oil storage space S11 can flow along the inner circumference of the balance weight with relatively low pressure through the gas drain hole 190, so as to move out of the compressor through the refrigerant discharge pipe 116 inside the casing 110.

In addition, the balance weight 123 extends in the circumferential direction by a predetermined angle. The balance weight 123 may have an approximately semicircular structure extending by 170 degrees to 190 degrees, and form a structure that is approximately half empty in the circumferential direction. With the structure of the balance weight 123, refrigerant can flow upward through an empty space in which the balance weight 123 does not extend.

For example, the upper communication portion 191 may include a main communication hole 191*a* and an upper discharge space 191*b*.

The main communication hole 191*a* may be formed in the vertical direction in the frame end plate 131 disposed on the upper side of the main frame 130.

The upper discharge space 191*b* is a space defined between the inner circumference of the balance weight 123 and the main bearing accommodating portion 133 of the main frame 130.

Figure 12:
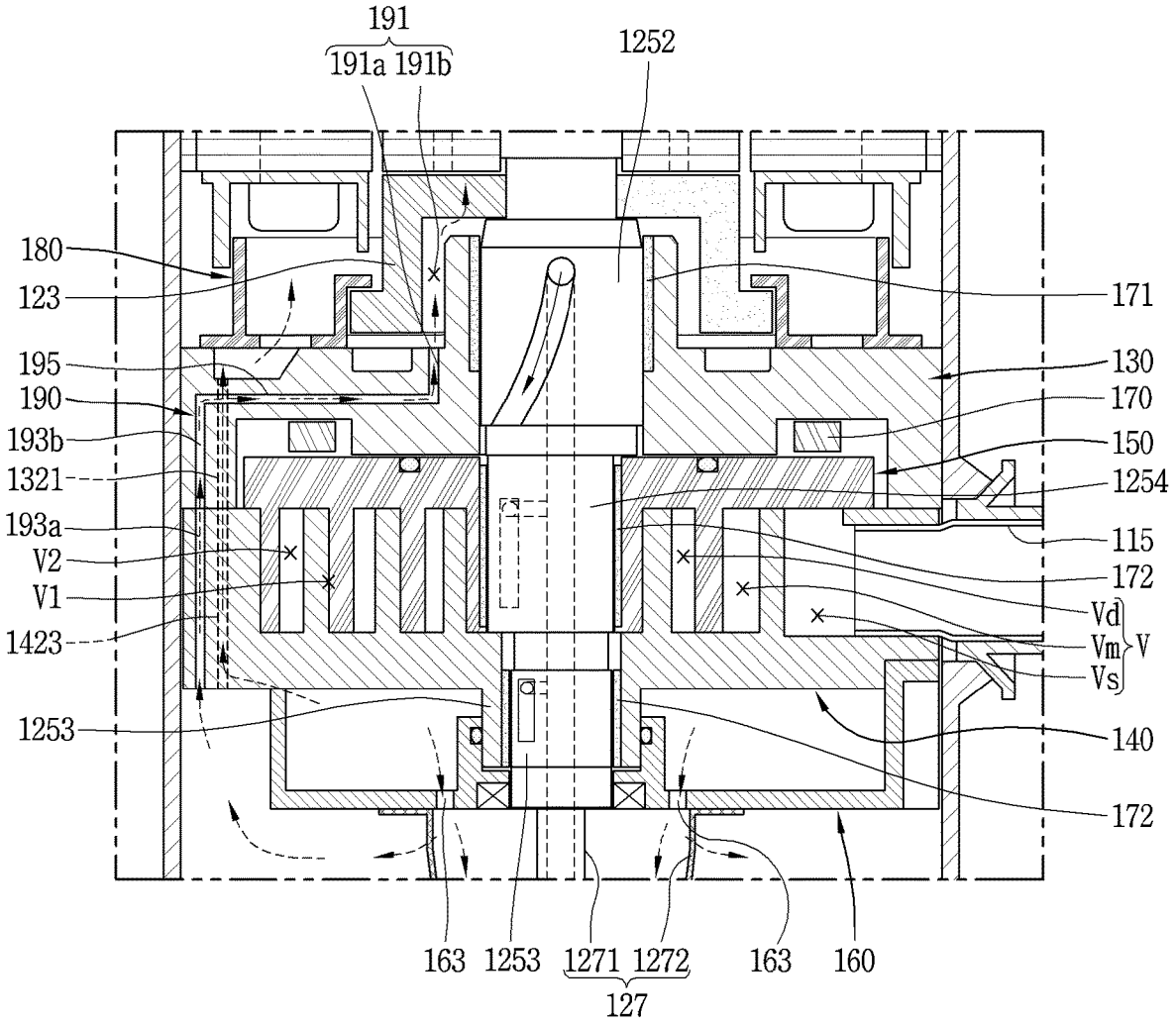
FIG. 12 is an enlarged sectional view illustrating the compression part of the scroll compressor according to the present disclosure.
Figure 13A:
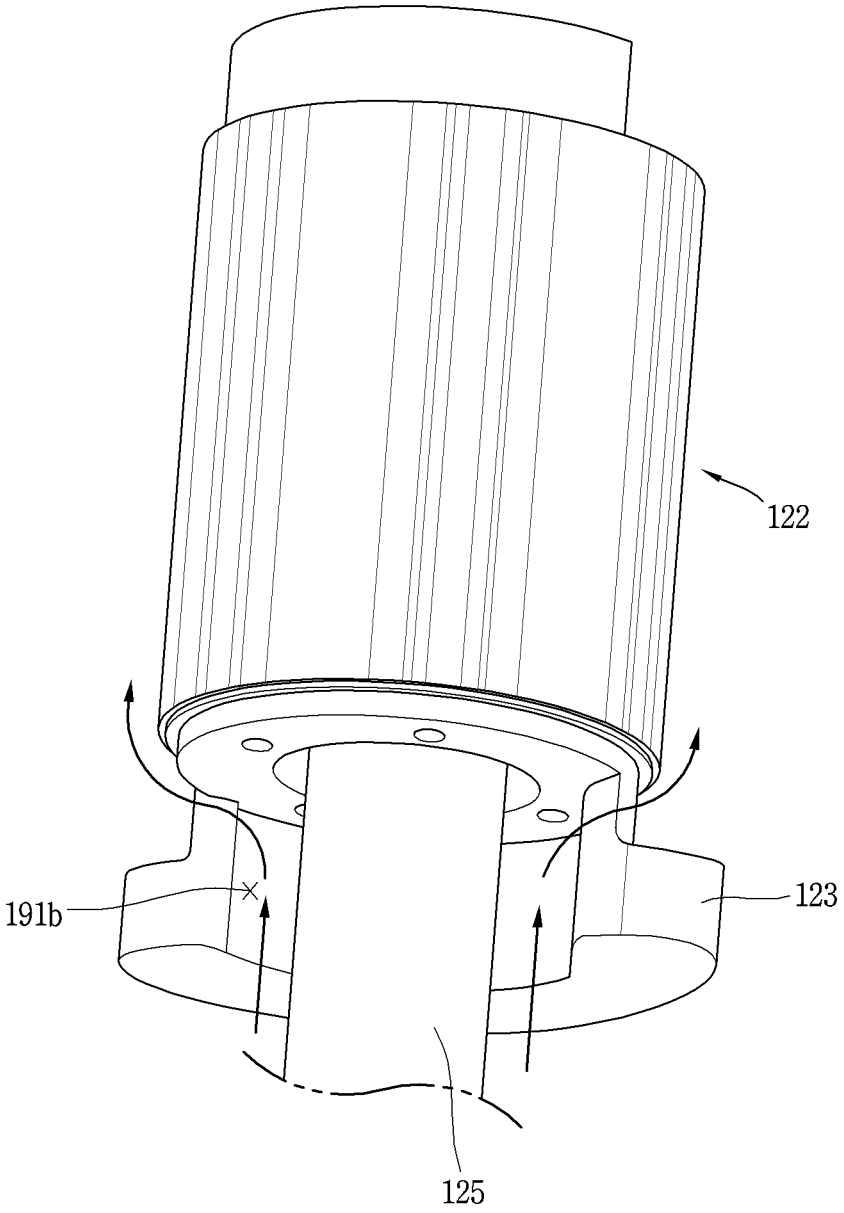
FIG. 13A is a perspective view illustrating a structure of a gas drain hole in a driving unit.
Figure 13B:
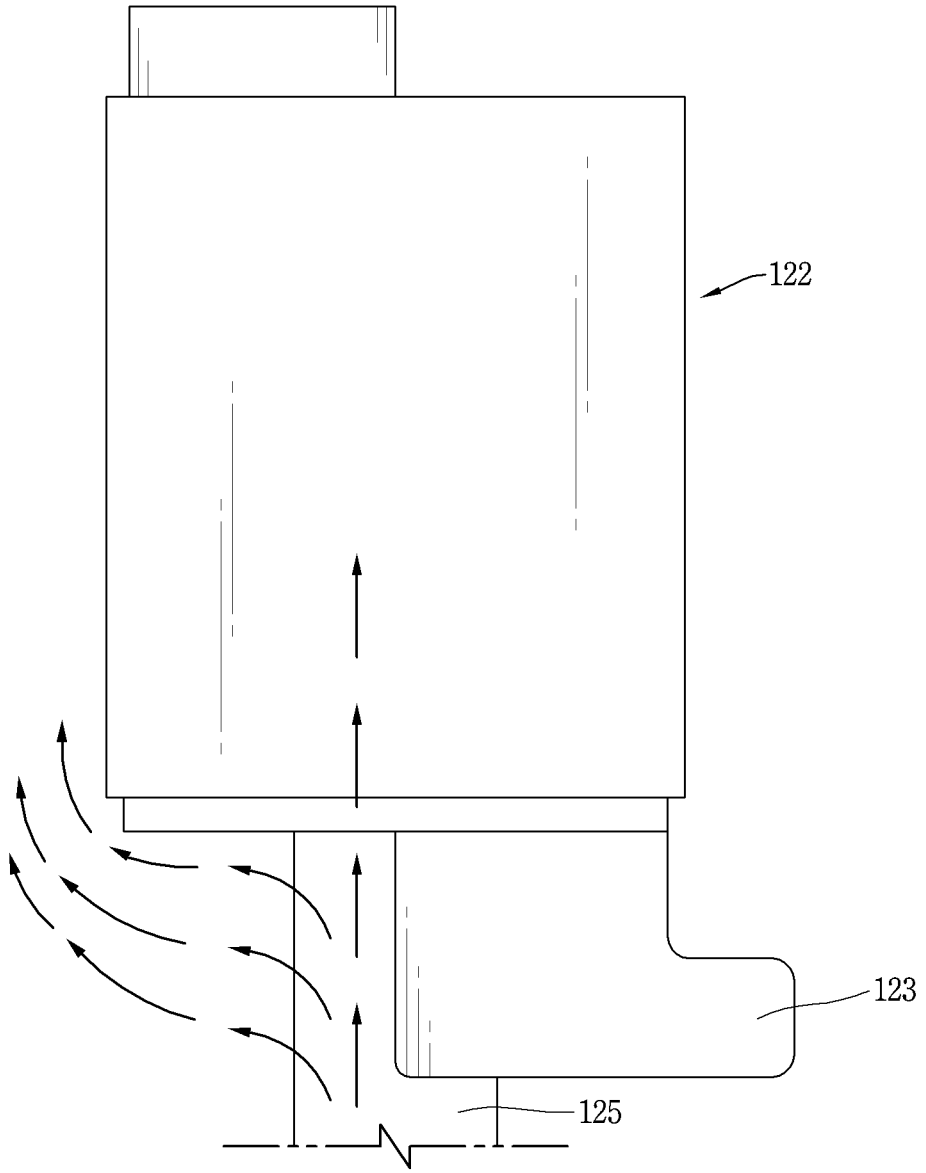
FIG. 13B is a sectional view illustrating a structure of a gas drain hole in a driving unit.

Referring to FIGS. 12, 13A, and 13B, an example in which the upper communication portion 191 is formed at the inner circumference of the balance weight 123, and refrigerant flows upward through the space where the balance weight 123 does not extend is illustrated.

The lower communication portion 193 may be formed in the vertical direction at an outer side of the compression part, more specifically, at an outer side of the fixed side wall of the fixed scroll 140 and the frame side wall of the main frame 130.

The lower communication portion 193 communicates with the discharge space S3, which is a space defined in the discharge cover 160, such that some of refrigerant gas in the discharge space S3 can flow to the upper communication portion 191 through the middle communication portion 195.

For example, the lower communication portion 193 may include a first communication hole 193*a* and a second communication hole 193*b*.

The first communication hole 193*a* may communicate in the vertical direction in the fixed side wall 142 of the fixed scroll 140, and in FIG. 12, an upper portion of the first communication hole 193*a* may communicate with the second communication hole 193*b* and a lower portion thereof may communicate with the oil storage space S11.

The second communication hole 193*b* may communicate in the vertical direction in the frame side wall 132 of the main frame 130, and in FIG. 12, an upper portion of the second communication hole 193*b* may communicate with the middle communication portion 195 and a lower portion thereof may communicate with the first communication hole 193*a*.

In addition, the middle communication portion 195 may be formed laterally in the frame end plate 131 of the main frame 130 to communicate between the upper communication portion 191 and the lower communication portion 193.

Figure 14:
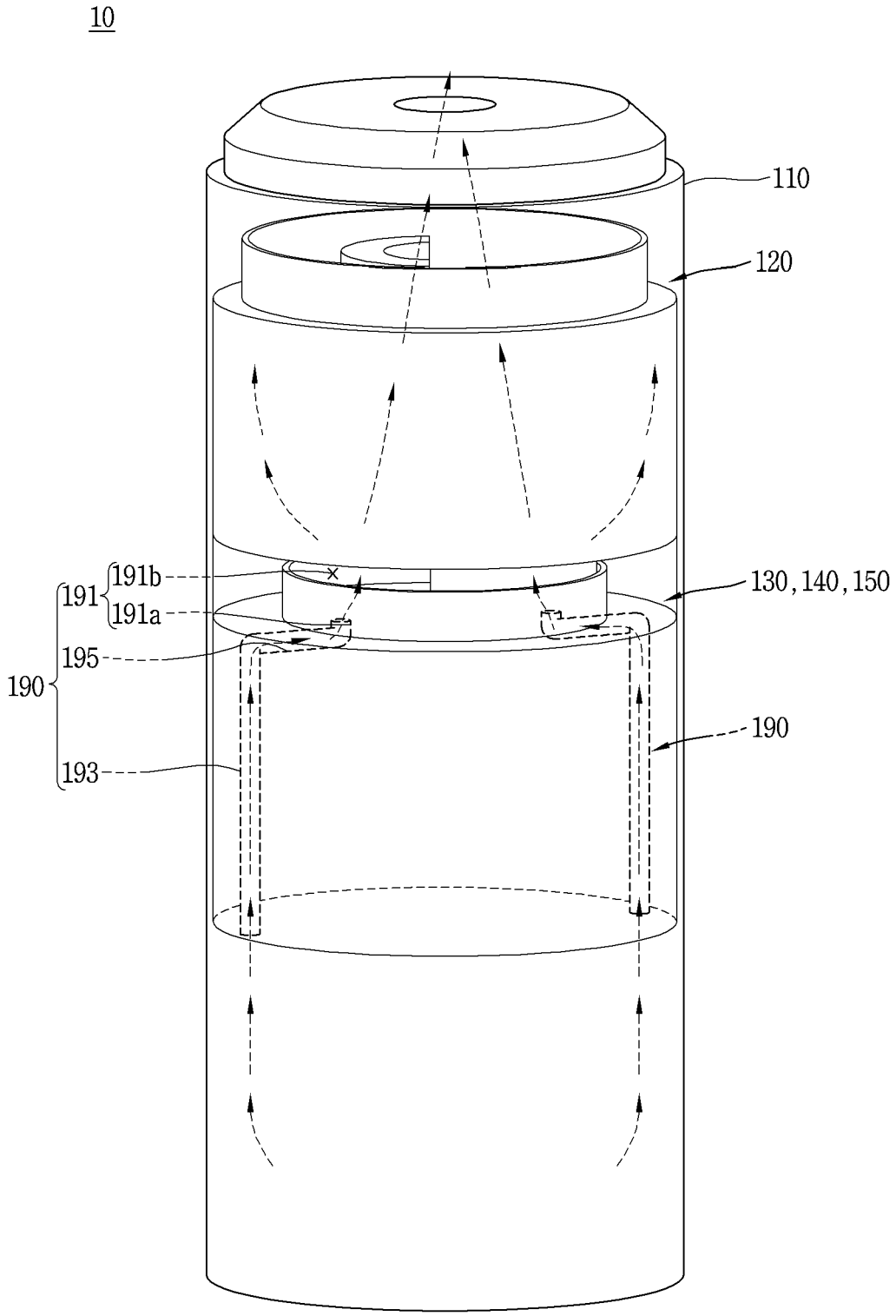
FIG. 14 is a conceptual view illustrating the structure of the gas drain hole in the driving unit.

Referring to FIGS. 12 to 14, the lower communication portion 193 is formed in the vertical direction in the fixed side wall 142 of the fixed scroll 140 and the frame end plate 131 of the main frame 130 so as to communicate with the discharge space S3 in the discharge cover 160, the middle communication portion 195 is formed in the frame end plate 131 of the main frame 130 such that the upper communication portion 191 and the lower communication portion 193 communicate with each other, and the upper communication portion 191 is formed in the vertical direction between the inner circumference of the balance weight 123 and the main bearing accommodating portion 133 of the main frame 130.

With the structure of the gas drain hole 190, differential pressure due to discharge refrigerant flowing into the storage space S11 can be eliminated, thereby improving circulation of the compressor, in particular, circulation of returned oil in the upper portion of the compressor.

The scroll compressor 10 according to the implementation may operate as follows.

That is, when power is applied to the driving motor 120, rotational force is generated and the rotor 122 and the rotating shaft 125 rotate accordingly. As the rotating shaft 125 rotates, the orbiting scroll 150 eccentrically coupled to the rotating shaft 125 performs an orbiting motion relative to the fixed scroll 140 by the Oldham ring 170.

Accordingly, a volume of a compression chamber V decreases gradually along a suction pressure chamber Vs defined at an outer side of the compression chamber V, an intermediate pressure chamber Vm continuously formed toward a center, and a discharge pressure chamber Vd defined in a central portion.

Then, refrigerant moves to the accumulator sequentially via a condenser, an expander, and an evaporator of a refrigeration cycle. The refrigerant then flows toward the suction pressure chamber Vs forming the compression chamber V through the refrigerant suction pipe 115.

The refrigerant suctioned into the suction pressure chamber Vs is compressed while moving to the discharge pressure chamber Vd via the intermediate pressure chamber Vm along a movement trajectory of the compression chamber V. The compressed refrigerant is discharged from the discharge pressure chamber Vd to the outflow space S12 of the discharge cover 60 through the discharge port 1411, 1412.

Then, the refrigerant (refrigerant is oil-mixed refrigerant but in description, mixed refrigerant or refrigerant will all be used) that has been discharged to the outflow space S12 of the discharge cover 160 moves to the outflow space S12 defined between the main frame 130 and the driving motor 120 through the outflow hole accommodating groove 1613 of the discharge cover 160 and the first outflow hole 1422 of the fixed scroll 140. The mixed refrigerant passes through the driving motor 120 to move to the upper space S2 of the casing 110 defined above the driving motor 120.

The mixed refrigerant moved to the upper space S2 is separated into refrigerant and oil in the upper space S2. The refrigerant (or some mixed refrigerant from which oil is not separated) flows out of the casing 110 through the refrigerant discharge pipe 116 so as to move to the condenser of the refrigeration cycle.

On the other hand, the oil separated from the refrigerant in the upper space S2 (or mixed oil with liquid refrigerant) moves to the lower space S1 along the first oil return passage Po1 between the inner circumferential surface of the casing 110 and the stator 121. The oil moved to the lower space S1 is returned to the oil storage space S11 defined in the lower portion of the compression part along the second oil return passage Po2 between the inner circumferential surface of the casing 110 and the outer circumferential surface of the compression part.

This oil is thusly supplied to each bearing surface through the oil feeding passage 126, and partially supplied into the compression chamber V. The oil supplied to the bearing surfaces and the compression chamber V is discharged to the discharge cover 160 together with refrigerant and then returned. This series of processes is repeatedly performed.

At this time, as the flow path guide 180 by which the refrigerant outflow passage and the oil return passage are separated is disposed in a space, namely, the outflow space S12 defined between the lower end of the driving motor 120 and the upper end of the main frame 130, the refrigerant that is discharged from the compression part and moves toward the upper space S2 can be suppressed from being mixed with the oil moving from the upper space S2 to the lower space S1.

In addition, the discharge hole 163 is formed through the cover bottom surface 1611 of the discharge cover 160 at the inner side of the inner circumference of the oil feeder 127. Accordingly, discharge refrigerant passed through the discharge hole 163 is spread at the inner side of the oil feeder 127. This can allow adjustment of temperature of oil in the oil storage space S11 and reduce scattering of oil due to injected refrigerant.

In addition, as the discharge refrigerant flows into the oil storage space S11 through the discharge hole 163, the pressure rises in the oil storage space S11 to generate differential pressure. The refrigerant in the storage space S11 in which pressure has risen passes through the lower communication portion 193, the middle communication portion 195, and the upper communication portion 191 of the gas drain hole 190, flows upward through the air gap or winding gap formed in the rotor, and moves out of the compressor through the refrigerant discharge pipe 116.

Figure 15:
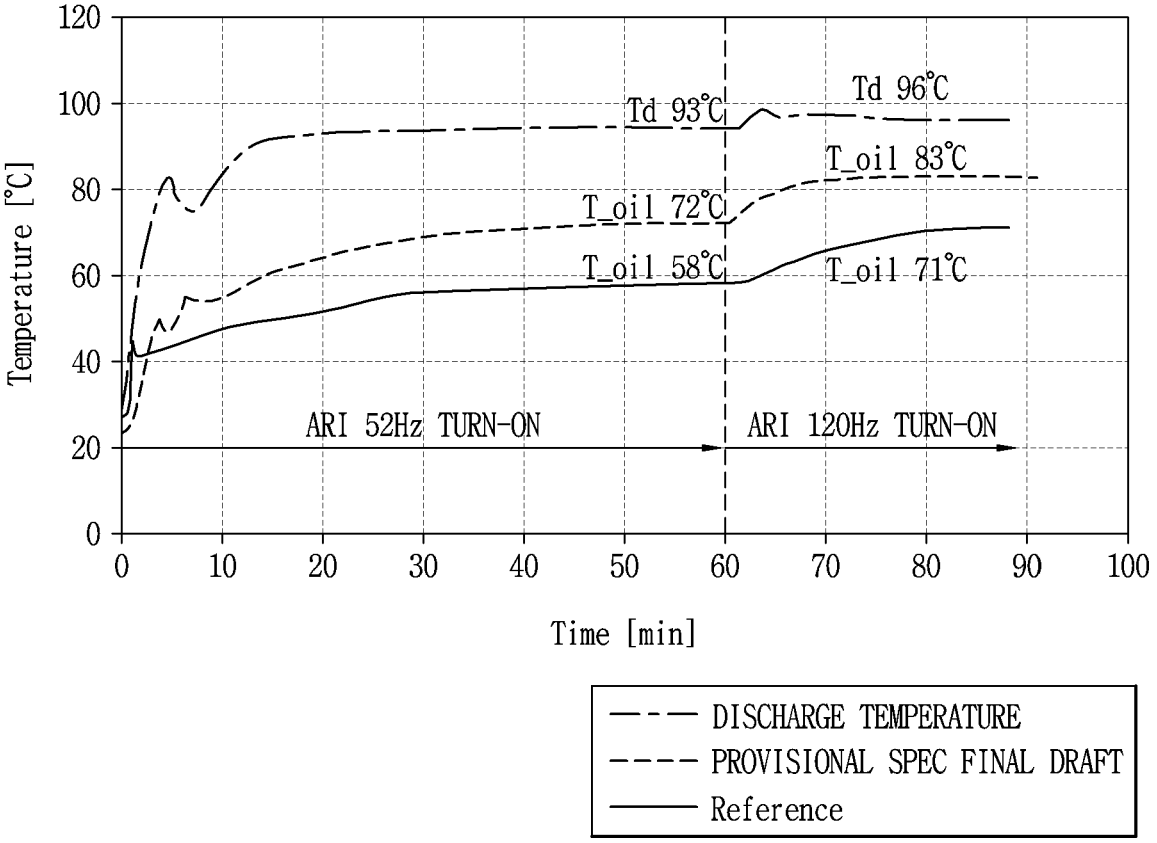
FIG. 15 is a graph showing experimental results in which temperature is increased by discharge refrigerant passing through the discharge hole.

FIG. 15 is a graph showing experimental results in which temperature is increased by discharge refrigerant passing through the discharge hole 163.

Referring to FIG. 15, when oil is left in low temperature/the compressor is turned on, the oil (with low viscosity) in the low-temperature state can increase in temperature within a short time by using discharge refrigerant that passes through the discharge hole 163 without using a heat or a branch pipe. In particular, an example in which oil temperature has increased by 12 to 14 degrees compared to the related art is shown in FIG. 15.

The scroll compressor of the present disclosure can adjust temperature of oil in the oil storage space without using a pipe.

First, a muffler hole that communicates with a discharge space and an oil storage space is formed through a discharge cover.

Accordingly, refrigerant collected in the discharge space is moved to the oil storage space through the muffler hole. The oil in the storage space can thus be brought into direct contact with and stirred with discharge refrigerant.

This may result in rapidly increasing temperature of the oil in the oil storage space at the beginning of an operation of the scroll compressor.

In addition, by virtue of the rapid increase in the temperature of the oil in the oil storage space, such oil can be prevented from being supplied in a low viscosity state.

This may result in preventing damage on bearings and lowering of an oil level due to oil with low viscosity.

In addition, as the oil inside the oil storage space is in direct contact with and stirred with the discharge refrigerant, a separate pipe branched from a refrigerant pipe may not be used and simultaneously the temperature of the oil in the oil storage space can be adjusted.

Accordingly, the scroll compressor can have a more simplified structure, and its manufacturing process can be further reduced.

In addition, production and maintenance costs of the scroll compressor can be reduced.

The number and size of muffler holes provided in the discharge cover can be adjusted according to a preset operation condition.

Accordingly, the scroll compressor can be operated at a discharge oil circulation ratio optimized for a preset operation condition.

In addition, as the discharge hole of the discharge cover is formed through the cover bottom surface located at the inner side of the oil feeder, scattering of oil due to injected refrigerant can be reduced while adjusting temperature of oil in the oil storage space.

The gas drain hole for resolving differential pressure in the lower portion of the compressor near the oil storage space can be formed, thereby improving circulation in the compressor, in particular, circulation of returned oil in the upper side of the compressor.

In particular, in the present disclosure, as the gas drain hole is formed in the inner circumference of the balance weight, refrigerant of high pressure in the oil storage space can flow along the inner circumference of the balance weight with relatively low pressure so as to be discharged to outside through the refrigerant discharge pipe disposed inside the casing, thereby relieving differential pressure in the lower portion of the compressor near the oil storage space.

The aforementioned scroll compressor 10 is not limited to the configuration and the method of the implementations described above, but the implementations may be configured such that all or some of the implementations are selectively combined so that various modifications can be made.

It will be apparent to those skilled in the art that the present invention may be embodied in other specific forms without departing from the spirit or essential characteristics thereof. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

What is claimed is:

1. A scroll compressor comprising:

a casing that defines an oil storage space;

a fixed scroll disposed inside the casing;

an orbiting scroll disposed at a first side of the fixed scroll and configured to perform an orbiting motion relative to the fixed scroll, wherein the orbiting scroll and the fixed scroll are configured to define a compression chamber therebetween;

a discharge cover coupled to a second side of the fixed scroll opposite to the first side of the fixed scroll, the discharge cover having a cover bottom surface; and an oil feeder that is coupled to the cover bottom surface and faces opposite to the fixed scroll, the oil feeder being in fluid communication with the oil storage space, wherein at least a portion of the cover bottom surface is disposed within an inner space surrounded by an inner circumferential surface of the oil feeder and defines a discharge hole in fluid communication with the inner space of the oil feeder.

2. The scroll compressor of claim 1, wherein the discharge cover comprises a cover side portion that extends from the cover bottom surface toward the fixed scroll, the discharge cover having a discharge space that is defined by the cover bottom surface, the cover side portion, and the fixed scroll.

3. The scroll compressor of claim 1, wherein the discharge cover comprises a refrigerant guide disposed at a position adjacent to the discharge hole in the cover bottom surface, the refrigerant guide extending away from the fixed scroll and toward the inner circumferential surface of the oil feeder to thereby interfere with refrigerant passing through the discharge hole.

4. The scroll compressor of claim 1, wherein the oil feeder comprises:

an oil suction pipe that is coupled to the discharge cover and passes through the discharge cover; and a mesh that accommodates the oil suction pipe and is configured to block introduction of foreign substances into the inner space of the oil feeder.

5. The scroll compressor of claim 1, further comprising a main frame that is disposed opposite to the fixed scroll with the orbiting scroll being interposed between the main frame and the fixed scroll, wherein at least one of the main frame or the fixed scroll defines a gas drain hole configured to guide gas in the oil storage space to thereby discharge the gas out of the casing.

6. The scroll compressor of claim 5, wherein the gas drain hole comprises:

an upper communication portion that passes through an upper surface of the main frame; and a lower communication portion that is in fluid communication with the oil storage space and configured to guide the gas in the oil storage space to the upper communication portion.

7. The scroll compressor of claim 6, wherein the gas drain hole further comprises a middle communication portion that extends through an upper portion of the main frame in a direction crossing the upper communication portion, the middle communication portion connecting the lower communication portion to the upper communication portion.

8. The scroll compressor of claim 7, wherein the main frame includes a frame side wall that extends from a lower surface of the main frame and defines a cylindrical shape, wherein the fixed scroll includes a fixed side wall that defines an annular shape and is coupled to the frame side wall, wherein the fixed side wall and the frame side wall face each other in a vertical direction, and wherein the lower communication portion comprises:

a first communication hole that passes through the fixed side wall in the vertical direction, and a second communication hole that passes through the frame side wall in the vertical direction, the second communication hole having (i) an upper portion in fluid communication with the middle communication portion and (ii) a lower portion in fluid communication with the first communication hole.

9. The scroll compressor of claim 6, further comprising:

a driving motor configured to generate rotational force that causes the orbiting motion of the orbiting scroll; and a balance weight coupled to the driving motor and disposed between the driving motor and the main frame, the balance weight extending in a circumferential direction of the driving motor and being configured to be rotated by the driving motor, wherein the upper communication portion extends to an inner circumferential surface of the balance weight.

10. The scroll compressor of claim 9, further comprising a bearing disposed in the main frame, wherein the main frame includes a main bearing accommodating portion that protrudes from the upper surface of the main frame and has an inner circumference facing the bearing, and wherein the upper communication portion is further defined between the inner circumferential surface of the balance weight and an outer circumferential surface of the main bearing accommodating portion.

11. The scroll compressor of claim 9, further comprising a bearing disposed in the main frame, wherein the main frame comprises:

a frame end plate that defines the upper surface of the main frame, and a main bearing accommodating portion that protrudes from the frame end plate and has an inner circumference facing the bearing, and wherein the upper communication portion includes:

a main communication hole that is defined in the frame end plate and extends in a vertical direction, and an upper discharge space that is in fluid communication with the main communication hole and defined between the inner circumferential surface of the balance weight and the main bearing accommodating portion.

12. A scroll compressor comprising:

a casing that defines an oil storage space;

a fixed scroll disposed inside the casing;

an orbiting scroll disposed at a first side of the fixed scroll and configured to perform an orbiting motion relative to the fixed scroll, wherein the orbiting scroll and the fixed scroll define a compression chamber therebetween; and a main frame disposed opposite to the fixed scroll with the orbiting scroll being disposed between the main frame and the fixed scroll, wherein at least one of the main frame or the fixed scroll defines a gas drain hole configured to guide gas in the oil storage space to thereby discharge the gas out of the casing, wherein the gas drain hole comprises:

an upper communication portion that passes through an upper surface of the main frame, a lower communication portion that is in fluid communication with the oil storage space and configured to guide the gas in the oil storage space to the upper communication portion, and a middle communication portion that extends through an upper portion of the main frame in a direction crossing the upper communication portion, the middle communication portion connecting the lower communication portion to the upper communication portion.

13. The scroll compressor of claim 12, wherein the main frame includes a frame side wall that extends from a lower surface of the main frame and defines a cylindrical shape, wherein the fixed scroll includes a fixed side wall that defines an annular shape and is coupled to the frame side wall, wherein the fixed side wall and the frame side wall face each other in a vertical direction, and wherein the lower communication portion comprises:

a first communication hole that passes through the fixed side wall in the vertical direction, and a second communication hole that passes through the frame side wall in the vertical direction, the second communication hole having (i) an upper portion in fluid communication with the middle communication portion and (ii) a lower portion in fluid communication with the first communication hole.

14. The scroll compressor of claim 12, further comprising:

a driving motor configured to generate rotational force that causes the orbiting motion of the orbiting scroll; and a balance weight coupled to the driving motor and disposed between the driving motor and the main frame, the balance weight extending in a circumferential direction of the driving motor and being configured to be rotated by the driving motor, wherein the upper communication portion extends to an inner circumferential surface of the balance weight.

15. The scroll compressor of claim 14, further comprising a bearing disposed in the main frame, wherein the main frame comprises:

a frame end plate that defines the upper surface of the main frame, and a main bearing accommodating portion that protrudes from the frame end plate and has an inner circumference facing the bearing, and wherein the upper communication portion includes:

a main communication hole that is defined in the frame end plate and extends in a vertical direction, and an upper discharge space that is in fluid communication with the main communication hole and defined between the inner circumferential surface of the balance weight and the main bearing accommodating portion.

16. A scroll compressor comprising:

a casing that defines an oil storage space;

a fixed scroll disposed inside the casing;

an orbiting scroll disposed at a first side of the fixed scroll and configured to perform an orbiting motion relative to the fixed scroll, wherein the orbiting scroll and the fixed scroll define a compression chamber therebetween;

a main frame disposed opposite to the fixed scroll with the orbiting scroll being disposed between the main frame and the fixed scroll; and a discharge cover coupled to a second side of the fixed scroll opposite to the first side of the fixed scroll, wherein at least one of the main frame or the fixed scroll defines a gas drain hole configured to guide gas in the oil storage space to thereby discharge the gas out of the casing, wherein the discharge cover comprises:

a cover bottom surface that defines a discharge hole in fluid communication with the oil storage space, and a cover side portion that extends from the cover bottom surface toward the fixed scroll and that is coupled to a lower surface of the fixed scroll, and wherein the discharge cover has a discharge space that is defined by the lower surface of the fixed scroll, the cover bottom surface, and the cover side portion.

17. The scroll compressor of claim 16, further comprising an oil feeder that is coupled to the cover bottom surface and faces opposite to the fixed scroll, the oil feeder being in fluid communication with the oil storage space, wherein the discharge hole is defined at a position of the cover bottom surface within an inner space surrounded by an inner circumference of the oil feeder, the discharge hole being in fluid communication with the inner space of the oil feeder.

18. The scroll compressor of claim 16, further comprising an oil feeder that is coupled to the cover bottom surface and faces opposite to the fixed scroll, the oil feeder being in fluid communication with the oil storage space, wherein the discharge hole is defined at a position of the cover bottom surface outside an outer circumference of the oil feeder.

19. The scroll compressor of claim 16, wherein the cover side portion defines a closed circumferential surface of the discharge cover that is connected to the lower surface of the fixed scroll.

20. The scroll compressor of claim 16, wherein the discharge hole extends through the cover bottom surface in an axial direction of the discharge cover.

* * * * *